US008810495B2

(12) United States Patent
Teranishi

(10) Patent No.: US 8,810,495 B2
(45) Date of Patent: Aug. 19, 2014

(54) DISPLAY DEVICE HAVING A PIXEL CIRCUIT, METHOD FOR DRIVING DISPLAY DEVICE, AND ELECTRONIC APPARATUS INCLUDING DISPLAY DEVICE

(75) Inventor: Yasuyuki Teranishi, Aichi (JP)

(73) Assignee: Japan Display West Inc., Chita-gun, Aichi-ken (JP)

( * ) Notice: Subject to any disclaimer, the term of this patent is extended or adjusted under 35 U.S.C. 154(b) by 291 days.

(21) Appl. No.: 13/159,625

(22) Filed: Jun. 14, 2011

(65) Prior Publication Data

US 2011/0316897 A1 Dec. 29, 2011

(30) Foreign Application Priority Data

Jun. 24, 2010 (JP) ..... 2010-144151
Jun. 24, 2010 (JP) ..... 2010-144153

(51) Int. Cl.
*G09G 3/36* (2006.01)

(52) U.S. Cl.
USPC ..... 345/96; 345/209

(58) Field of Classification Search
USPC ..... 345/96, 209
See application file for complete search history.

(56) References Cited

U.S. PATENT DOCUMENTS

| | | | | |
|---|---|---|---|---|
| 7,173,589 | B2 * | 2/2007 | Senda et al. | 345/90 |
| 2002/0075205 | A1 | 6/2002 | Kimura et al. | |
| 2002/0089471 | A1 * | 7/2002 | Murata et al. | 345/55 |
| 2003/0016202 | A1 | 1/2003 | Edwards et al. | |
| 2003/0098860 | A1 | 5/2003 | Nakamura et al. | |
| 2005/0207212 | A1 | 9/2005 | Tsujimura et al. | |
| 2006/0181539 | A1 | 8/2006 | Akimoto | |
| 2007/0002082 | A1 | 1/2007 | Sakurai | |
| 2008/0238855 | A1 * | 10/2008 | Teranishi et al. | 345/98 |
| 2009/0096947 | A1 | 4/2009 | Teranishi et al. | |
| 2010/0149080 | A1 * | 6/2010 | Teranishi et al. | 345/87 |

FOREIGN PATENT DOCUMENTS

| | | |
|---|---|---|
| JP | 2001-166749 | 6/2001 |
| JP | 2002-229532 | 8/2002 |
| JP | 2002-297100 | 10/2002 |
| JP | 2003-228347 | 8/2003 |
| JP | 2004-191574 | 7/2004 |
| JP | 2004-536337 | 12/2004 |
| JP | 2005-267694 | 9/2005 |
| JP | 2006-227233 | 8/2006 |
| JP | 2006-343609 | 12/2006 |
| JP | 2009-98234 | 5/2009 |

OTHER PUBLICATIONS

Japanese Office Action issued Oct. 15, 2013 for corresponding Japanese Appln. No. 2010-144151.

* cited by examiner

*Primary Examiner* — Kwang-Su Yang
(74) *Attorney, Agent, or Firm* — K&L Gates LLP

(57) ABSTRACT

The present application provides a display device having a pixel circuit including: a pixel electrode; a capacitive element configured to be connected to the pixel electrode of liquid crystal capacitance and hold a signal potential reflecting a grayscale; and an inverter circuit configured to invert polarity of a held potential read out from the capacitive element, wherein input potential of the inverter circuit is set to middle potential in an operating supply voltage range of the inverter circuit in operation of inverting the polarity of the held potential and writing an inverted potential to the capacitive element again after reading out the held potential from the capacitive element.

12 Claims, 22 Drawing Sheets

FIG. 5A POTENTIAL OF SIGNAL LINE

FIG. 5B $GATE_1$ /$GATE_2$

FIG. 5C $SR_1$/$SR_2$ $GATE_2$ $SR_1/SR_2$ $V_{CS}$

PIX

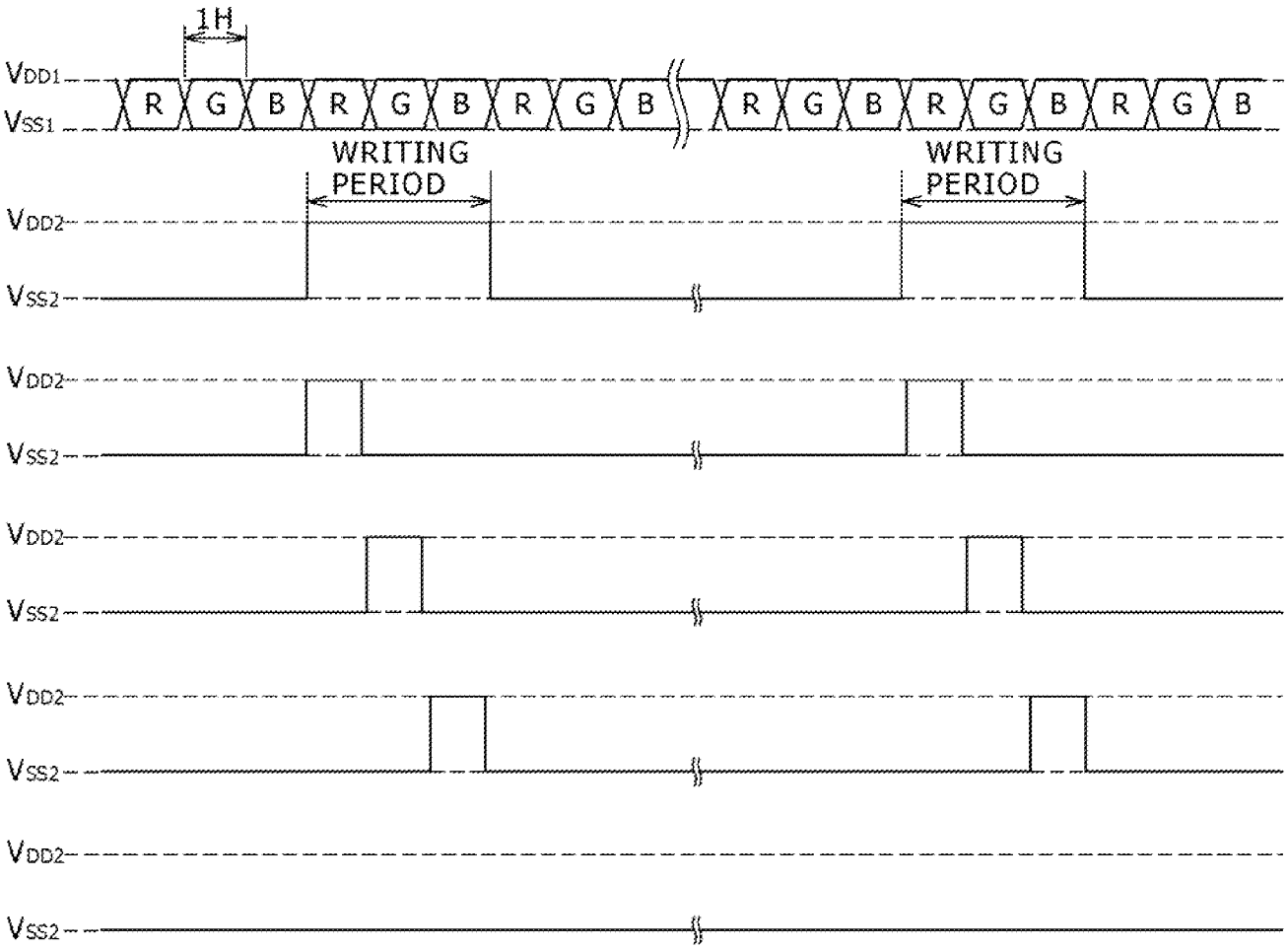
FIG.9A POTENTIAL OF SIGNAL LINE
FIG.9B $GATE_1$
FIG.9C $GATE_{2R}$
FIG.9D $GATE_{2G}$
FIG.9E $GATE_{2B}$
FIG.9F $SR_1/SR_2$ $GATE_{2R}$ $GATE_{2G}$ $GATE_{2B}$ $SR_1/SR_2$ $V_{CS}$ $PIX_R$ $PIX_G$ $PIX_B$

FRAME N
FRAME N+1
1H

POTENTIAL OF SIGNAL LINE
VDD2
VSS2
Vmid

GATE1
VDD2
VSS2

GATE2G
VDD2
VSS2

SR1
VDD2
VSS2

SR2
VDD2
VSS2

PIXG
VDD1
VSS1

INVin
VDD1
ΔV1
ΔV2
Vmid
VSS1

INVout
VDD1
VSS1

FRAME N
FRAME N+1
1H

POTENTIAL OF SIGNAL LINE
VDD2
VSS2

GATE1
VDD2
VSS2

GATE2G
VDD2
VSS2

SR1
VDD2
VSS2

SR2
VDD2
VSS2

PIXG
VDD1
VSS1

INVin
ΔV1
ΔV2
VDD1
Vmid
VSS1

INVout
VDD1
VSS1

DISPLAY DEVICE HAVING A PIXEL CIRCUIT, METHOD FOR DRIVING DISPLAY DEVICE, AND ELECTRONIC APPARATUS INCLUDING DISPLAY DEVICE

CROSS REFERENCES TO RELATED APPLICATIONS

The present application claims priority to Japanese Priority Patent Applications JP 2010-144151 and JP 2010-144153 filed in the Japan Patent Office on Jun. 24, 2010 respectively, the entire contents of which are hereby incorporated by reference.

BACKGROUND

The present application relates to display devices, methods for driving a display device, and electronic apparatus, and particularly to a display device having a memory to store image data in the pixel, a method for driving this display device, and electronic apparatus having this display device.

Among display devices are ones having a memory to store image data in the pixel. In e.g. a display device having a built-in memory in the pixel, displaying by an analog display mode and displaying by a memory display mode can be realized. The analog display mode refers to a display mode in which the grayscale of the pixel is displayed in an analog manner. The memory display mode refers to a display mode in which the grayscale of the pixel is displayed in a digital manner based on binary information (logic "1"/"0") stored in the memory in the pixel.

In the memory display mode, it is unnecessary to carry out operation of writing the signal potential reflecting the grayscale with the frame cycle because information retained in the memory is used. Therefore, in the memory display mode, the power consumption is lower than that in the analog display mode, in which it is necessary to carry out operation of writing the signal potential reflecting the grayscale with the frame cycle.

As a related-art display device capable of both displaying by the analog display mode and displaying by the memory display mode, a display device in which a static random access memory (SRAM) is used as the built-in memory in the pixel is known (refer to e.g. Japanese Patent Laid-Open No. 2009-98234).

FIG. 21 shows one example of a pixel circuit of a liquid crystal display device according to a related-art example using the SRAM as the memory in the pixel. A pixel 90 in the liquid crystal display device according to the present related-art example has liquid crystal capacitance 91, holding capacitance 92, an SRAM 93, and five switching transistors 94 to 98. To the pixel 90, a signal potential $V_{sig}$ reflecting the grayscale or a potential $V_{XCS}$ different from a common potential $V_{COM}$ is selectively given via a signal line 99.

The liquid crystal capacitance 91 means the capacitance generated between a pixel electrode and a counter electrode formed opposed to the pixel electrode when a liquid crystal is enclosed between the pixel electrode and the counter electrode. The common potential $V_{COM}$ is given to the counter electrode of the liquid crystal capacitance 91 in common to all pixels. The pixel electrode of the liquid crystal capacitance 91 is electrically connected to one electrode of the holding capacitance 92 in common. The holding capacitance 92 holds the signal potential $V_{sig}$ reflecting the grayscale. A CS potential $V_{CS}$ that is almost the same as the common potential $V_{COM}$ is given to the other electrode of the holding capacitance 92.

The SRAM 93 is composed of two CMOS inverters provided between a positive-side supply potential $V_{RAM}$ and a negative-side supply potential $V_{SS}$. The input terminal of one of these two CMOS inverters is connected to the output terminal of the other in common. The input terminal of the other is connected to the output terminal of one in common.

Of two CMOS inverters configuring the SRAM 93, one CMOS inverter is composed of a PchMOS transistor 931 and an NchMOS transistor 932 that are connected in series between the supply potential $V_{RAM}$ and the supply potential $V_{SS}$ and have gate electrodes connected in common. The other CMOS inverter is composed of a PchMOS transistor 933 and an NchMOS transistor 934 that are connected in series between the supply potential $V_{RAM}$ and the supply potential $V_{SS}$ and have gate electrodes connected in common.

Five switching transistors 94 to 98 are formed of e.g. thin film transistors. The conductive/non-conductive state of the switching transistors 94 and 95 is controlled by a control signal $C_{TL1}$. Specifically, the switching transistors 94 and 95 become the conductive state in response to the control signal $C_{TL1}$ that becomes the active (higher potential) state in writing of the signal potential $V_{sig}$ reflecting the grayscale to the holding capacitance 92.

The switching transistor 96 becomes the conductive state in writing of the signal potential $V_{sig}$ reflecting the grayscale in the analog display mode or in writing of the potential $V_{XCS}$ different from the common potential $V_{COM}$ in the memory display mode. The switching transistor 97 becomes the conductive state in writing of the CS potential $V_{CS}$, which is almost the same as the common potential $V_{COM}$ given to the counter electrode of the liquid crystal capacitance 91, to the holding capacitance 92 in the memory display mode.

The held potential of the SRAM 93 is used for control of the conductive/non-conductive state of the switching transistors 96 and 97. In this circuit example, the switching transistor 97 is in the non-conductive state when the switching transistor 96 is in the conductive state, and the switching transistor 97 is in the conductive state when the switching transistor 96 is in the non-conductive state.

The conduction control of the switching transistor 98 is carried out by a control signal $C_{TL2}$ that becomes the active (higher potential) state in writing of a control potential to the SRAM 93. Specifically, the switching transistor 98 becomes the conductive state in response to the control signal $C_{TL2}$ that becomes the active state in writing of the signal potential $V_{sig}$ to the SRAM 93 in the analog display mode or in writing of the potential $V_{XCS}$ to the SRAM 93 in the memory display mode.

Although the pixel circuit example in which the SRAM 93 is provided for each pixel 90 based on a one-to-one correspondence relationship is shown in FIG. 21, it is also possible to employ a configuration in which one SRAM 93 is provided (shared) in common to the plural pixels 90.

As one example, as shown in FIG. 22, it is also possible to provide one SRAM 93 in common to e.g. sub-pixels $\mathbf{90}_R$, $\mathbf{90}_G$, and $\mathbf{90}_B$ of red (R), green (G), and blue (B) configuring one pixel 90 in a liquid crystal display device for color displaying. Although holding capacitances $\mathbf{92}_R$, $\mathbf{92}_G$, and $\mathbf{92}_B$ of the sub-pixels $\mathbf{90}_R$, $\mathbf{90}_G$, and $\mathbf{90}_B$ are shown in FIG. 22, diagrammatic representation of the respective liquid crystal capacitances 91 of the sub-pixels $\mathbf{90}_R$, $\mathbf{90}_G$, and $\mathbf{90}_B$ is omitted for simplification of the diagram.

In the case of employing the configuration in which one SRAM 93 is shared by the sub-pixels $\mathbf{90}_R$, $\mathbf{90}_G$, and $\mathbf{90}_B$, the switching transistor 94 ($\mathbf{94}_R$, $\mathbf{94}_G$, $\mathbf{94}_B$) is disposed for each of the sub-pixels $\mathbf{90}_R$, $\mathbf{90}_G$, and $\mathbf{90}_B$. The conductive/non-conductive state of these switching transistors $\mathbf{94}_R$, $\mathbf{94}_G$, and $\mathbf{94}_B$ is controlled in a time-division manner by control signals $C_{TL1}(R)$, $C_{TL1}(G)$, and $C_{TL1}(B)$ corresponding to the respective colors.

SUMMARY

If the pixel configuration in which the SRAM 93 is used as the memory in the pixel as described above is employed, microminiaturization of the pixel 90 is precluded because the structure of the SRAM 93 is complex and the SRAM 93 occupies a large area in the pixel 90.

In general, it is known that the structure of a dynamic random access memory (DRAM) is simpler than that of the SRAM. However, in the case of the DRAM, the memory needs to be refreshed for data retention and therefore the power consumption is higher than that of the SRAM.

There is a need for the present application to provide a display device, a method for driving a display device, and electronic apparatus enabling performance enhancement such as power consumption reduction and improvement in the operating margin of a DRAM in a configuration in which a capacitive element to hold the signal potential is utilized as the DRAM for simplification of the pixel structure.

According to an embodiment, there is provided a display device having a pixel circuit including a pixel electrode, a capacitive element configured to be connected to the pixel electrode of liquid crystal capacitance and hold a signal potential reflecting a grayscale, and an inverter circuit configured to invert the polarity of a held potential read out from the capacitive element, wherein the input potential of the inverter circuit is set to middle potential in the operating supply voltage range of the inverter circuit in operation of inverting the polarity of the held potential and writing an inverted potential to the capacitive element again after reading out the held potential from the capacitive element.

According to a more specific configuration example, there is provided a liquid crystal display device obtained by disposing pixels each including liquid crystal capacitance, a capacitive element having one electrode connected to a pixel electrode of the liquid crystal capacitance, a first switch element that has one terminal connected to a signal line and is set to an on-state in a first operating mode of writing a signal potential that is given via the signal line and reflects a grayscale to the capacitive element, the first switch element being set to an off-state in a second operating mode of inverting the polarity of a held potential and writing an inverted potential to the capacitive element again after reading out the held potential from the capacitive element, a second switch element that has one terminal connected to the other terminal of the first switch element and has the other terminal connected to one electrode of the capacitive element and the pixel electrode, the second switch element being set to an on-state in the first operating mode and a reading period for reading out the held potential from the capacitive element and a rewriting period for writing the inverted potential to the capacitive element again in the second operating mode, a third switch element that has one terminal connected to the other terminal of the first switch element and is set to an off-state in the first operating mode, the third switch element being set to an on-state in the reading period in the second operating mode and reading out the held potential from the capacitive element via the second switch element, an inverter circuit that has an input terminal connected to the other terminal of the third switch element and inverts the polarity of the held potential read out from the capacitive element via the second switch element and the third switch element in the reading period in the second operating mode, and a fourth switch element that has one terminal connected to the other terminal of the first switch element and has the other terminal connected to an output terminal of the inverter circuit, the fourth switch element being set to an off-state in the first operating mode, the fourth switch element being set to an on-state in the rewriting period in the second operating mode and writing the inverted potential obtained by polarity inversion by the inverter circuit to the capacitive element via the second switch element.

This liquid crystal display device employs such a configuration as to perform, for the pixel, driving to set the input potential of the inverter circuit to middle potential in the operating supply voltage range of the inverter circuit before start of the reading period in the second operating mode.

In the display device having the above-described configuration, in the first operating mode, the third switch element and the fourth switch element are in the off-state. Therefore, due to setting of the first switch element and the second switch element to the on-state, the signal potential (analog potential or binary potential) reflecting the grayscale is written from the signal line to the capacitive element via these first and second switch elements. In the second operating mode, operation (rewriting operation) of writing the inverted potential to the capacitive element again after reading out the held potential of the capacitive element to the input terminal of the inverter circuit and performing polarity inversion (logic inversion) by the inverter circuit is carried out.

In this second operating mode, operation of giving the middle potential in the operating supply voltage range of the inverter circuit to the input terminal of the inverter circuit is carried out before start of the period of reading of the held potential from the capacitive element. Furthermore, in the off-state of the first switch element, the second switch element and the third switch element become the on-state, whereas the fourth switch element is kept at the off-state. At this time, the held potential of the capacitive element is read out via the second switch element and the third switch element and given to the input terminal of the inverter circuit.

The input terminal of the inverter circuit has capacitance (input capacitance) so that the input potential can be held. If the middle potential is not given to the input terminal of the inverter circuit before start of the period of reading of the held potential from the capacitive element, capacitance distribution occurs between the capacitive element and the input capacitance of the inverter circuit in application of the held potential of the capacitive element to the input terminal of the inverter circuit. Specifically, if the potential difference between the applied held potential and the input potential of the inverter circuit before the application is large, the capacitance distribution occurs in application of the held potential of the capacitive element to the input terminal of the inverter circuit. Due to this capacitance distribution, the input potential of the inverter circuit is lowered by the potential dependent on the capacitance ratio between the capacitive element and the input capacitance of the inverter circuit. Thus, the operating margin of the inverter circuit becomes smaller.

In contrast, by setting the input potential of the inverter circuit to the middle potential before start of the period of reading of the held potential from the capacitive element, the potential difference between the applied held potential and the input potential of the inverter circuit before the application becomes smaller than that when the input potential is not set to the middle potential. Due to this feature, in application of the held potential of the capacitive element to the input terminal of the inverter circuit, the amount of lowering of the input potential of the inverter circuit, which is lowered due to capacitance distribution, is smaller than that when the middle potential is not given.

When the held potential of the capacitive element is given to the input terminal of the inverter circuit, the inverter circuit inverts the polarity of the held potential. Thereafter, the third switch element becomes the off-state and the fourth switch element becomes the on-state. The fourth switch element carries out operation (rewriting operation) of writing the output potential of the inverter circuit, i.e. the inverted potential of the held potential, to the capacitive element again via the second switch element.

So-called refresh operation is carried out by the series of operation in this second operating mode, i.e. the reading operation of reading out the held potential from the capacitive element and the rewriting operation of writing the inverted potential obtained by inverting the polarity of the held potential to the capacitive element again. This refresh operation is carried out in the state in which the pixel is isolated from the signal line due to the operation of the first switch element. Therefore, in the refresh operation, the signal line having high load capacitance is neither charged nor discharged. Furthermore, in the refresh operation, the operation of inverting the polarity of the potential held in the capacitive element is repeated with the repetition cycle of the second operating mode due to the operation of the inverter circuit.

According to another embodiment, there is provided a display device having a pixel circuit including a pixel electrode, a capacitive element configured to be connected to the pixel electrode and hold a signal potential reflecting a grayscale, and an inverter circuit configured to invert the polarity of a held potential read out from the capacitive element, wherein the pixel circuit carries out operation of inverting the polarity of the held potential and writing an inverted potential to the capacitive element again after reading out the held potential from the capacitive element, and performs driving to give a supply potential from the signal line to an input terminal of the inverter circuit for a certain period after the operation, i.e. for a certain period after the writing of the inverted potential to the pixel.

According to a more specific configuration example, there is provided a liquid crystal display device obtained by disposing pixels each including liquid crystal capacitance, a capacitive element having one electrode connected to a pixel electrode of the liquid crystal capacitance, a first switch element that has one terminal connected to a signal line and is set to an on-state in a first operating mode of writing a signal potential that is given via the signal line and reflects a grayscale to the capacitive element, the first switch element being set to an off-state in a second operating mode of inverting the polarity of a held potential and writing an inverted potential to the capacitive element again after reading out the held potential from the capacitive element, a second switch element that has one terminal connected to the other terminal of the first switch element and has the other terminal connected to one electrode of the capacitive element and the pixel electrode, the second switch element being set to an on-state in the first operating mode and a reading period for reading out the held potential from the capacitive element and a rewriting period for writing the inverted potential to the capacitive element again in the second operating mode, a third switch element that has one terminal connected to the other terminal of the first switch element and is set to an off-state in the first operating mode, the third switch element being set to an on-state in the reading period in the second operating mode and reading out the held potential from the capacitive element via the second switch element, an inverter circuit that has an input terminal connected to the other terminal of the third switch element and inverts the polarity of the held potential read out from the capacitive element via the second switch element and the third switch element in the reading period in the second operating mode, and a fourth switch element that has one terminal connected to the other terminal of the first switch element and has the other terminal connected to an output terminal of the inverter circuit, the fourth switch element being set to an off-state in the first operating mode, the fourth switch element being set to an on-state in the rewriting period in the second operating mode and writing the inverted potential obtained by polarity inversion by the inverter circuit to the capacitive element via the second switch element.

This liquid crystal display device employs such a configuration as to perform, for the pixel, driving to give a supply potential from the signal line to the input terminal of the inverter circuit via the first switch element and the third switch element for a certain period after writing of the inverted potential by the fourth switch element.

In the liquid crystal display device having the above-described configuration, in the first operating mode, the third switch element and the fourth switch element are in the off-state. Therefore, due to setting of the first switch element and the second switch element to the on-state, the signal potential (analog potential or binary potential) reflecting the grayscale is written from the signal line to the capacitive element via these first and second switch elements. In the second operating mode, the first switch element is set to the off-state. In this state, the second switch element and the third switch element become the on-state, whereas the fourth switch element is kept at the off-state. At this time, the held potential of the capacitive element is read out via the second switch element and the third switch element and given to the input terminal of the inverter circuit. Thereupon, the inverter circuit inverts the polarity of the held potential of the capacitive element. Thereafter, the third switch element becomes the off-state and the fourth switch element becomes the on-state. The fourth switch element writes the output potential of the inverter circuit, i.e. the inverted potential of the held potential, to the capacitive element via the second switch element (rewriting operation).

So-called refresh operation is carried out by the series of operation in this second operating mode, i.e. the reading operation of reading out the held potential from the capacitive element and the rewriting operation of writing the inverted potential obtained by inverting the polarity of the held potential to the capacitive element again. This refresh operation is carried out in the state in which the pixel is isolated from the signal line due to the operation of the first switch element. Therefore, in the refresh operation, the signal line having high load capacitance is neither charged nor discharged. Furthermore, in the refresh operation, the operation of inverting the polarity of the potential held in the capacitive element is repeated with the repetition cycle of the second operating mode due to the operation of the inverter circuit.

For a certain period after the refresh operation, specifically for a certain period after writing of the inverted potential by the fourth switch element, the first switch element and the third switch element become the on-state. At this time, the potential of the signal line is a supply potential and the supply potential is given to the input terminal of the inverter circuit via the first switch element and the third switch element. Thereby, the input potential of the inverter circuit is settled to the supply potential. If the input potential of the inverter circuit is in an unsettled state, the through current flows through the inverter circuit and increase in the power consumption is caused. In contrast, the settling of the input potential of the inverter circuit to the supply potential avoids the flow of the through current through the inverter circuit.

According to the embodiments, in the configuration in which the capacitive element to hold the signal potential in the pixel is utilized as a DRAM for simplification of the pixel structure, charge and discharge of the signal line having high load capacitance are unnecessary in refresh operation and therefore the power consumption accompanying the refresh operation can be suppressed.

Furthermore, in the first embodiment, the input potential of the inverter circuit is set to the middle potential before reading of the held potential from the capacitive element and thereby potential lowering due to capacitance distribution can be suppressed. Therefore, the operating margin of the inverter circuit and hence the DRAM can be improved (enlarged) compared with the case in which the input potential is not set to the middle potential.

In the second embodiment, the flow of the through current through the inverter circuit can be avoided by settling the input potential of the inverter circuit to a supply potential after refresh operation. Thus, the power consumption can be further suppressed.

Additional features and advantages are described herein, and will be apparent from the following Detailed Description and the figures.

BRIEF DESCRIPTION OF THE FIGURES

FIGS. 9A to 9F are timing waveform diagrams for explaining the operation of the analog display mode of the pixel circuit according to pixel configuration example 2;

FIG. 17A is a perspective view of the front side and FIG. 17B is a perspective view of the back side;

FIG. 20A is a front view of the opened state, FIG. 20B is a side view of the opened state, FIG. 20C is a front view of the closed state, FIG. 20D is a left side view, FIG. 20E is a right side view, FIG. 20F is a top view, and FIG. 20G is a bottom view;

DETAILED DESCRIPTION

Embodiments of the present application will be described below in detail with reference to the drawings.

1. Liquid Crystal Display Device to Which Embodiment Is Applied 1-1. System Configuration 1-2. Panel Sectional Structure 2. Description of Liquid Crystal Display Device According to Embodiment 2-1. Pixel Configuration Example 1 (example in which inverter circuit is disposed for each pixel)

2-2. Pixel Configuration Example 2 (example in which one inverter circuit is shared by three sub-pixels)

2-3. Operation Example 1 (example in which middle potential is given to input terminal of inverter circuit)

2-4. Operation Example 2 (example in which input and output terminals of inverter circuit are electrically connected)

3. Modification Example

4. Application Examples (Electronic Apparatus)

Figure 1:
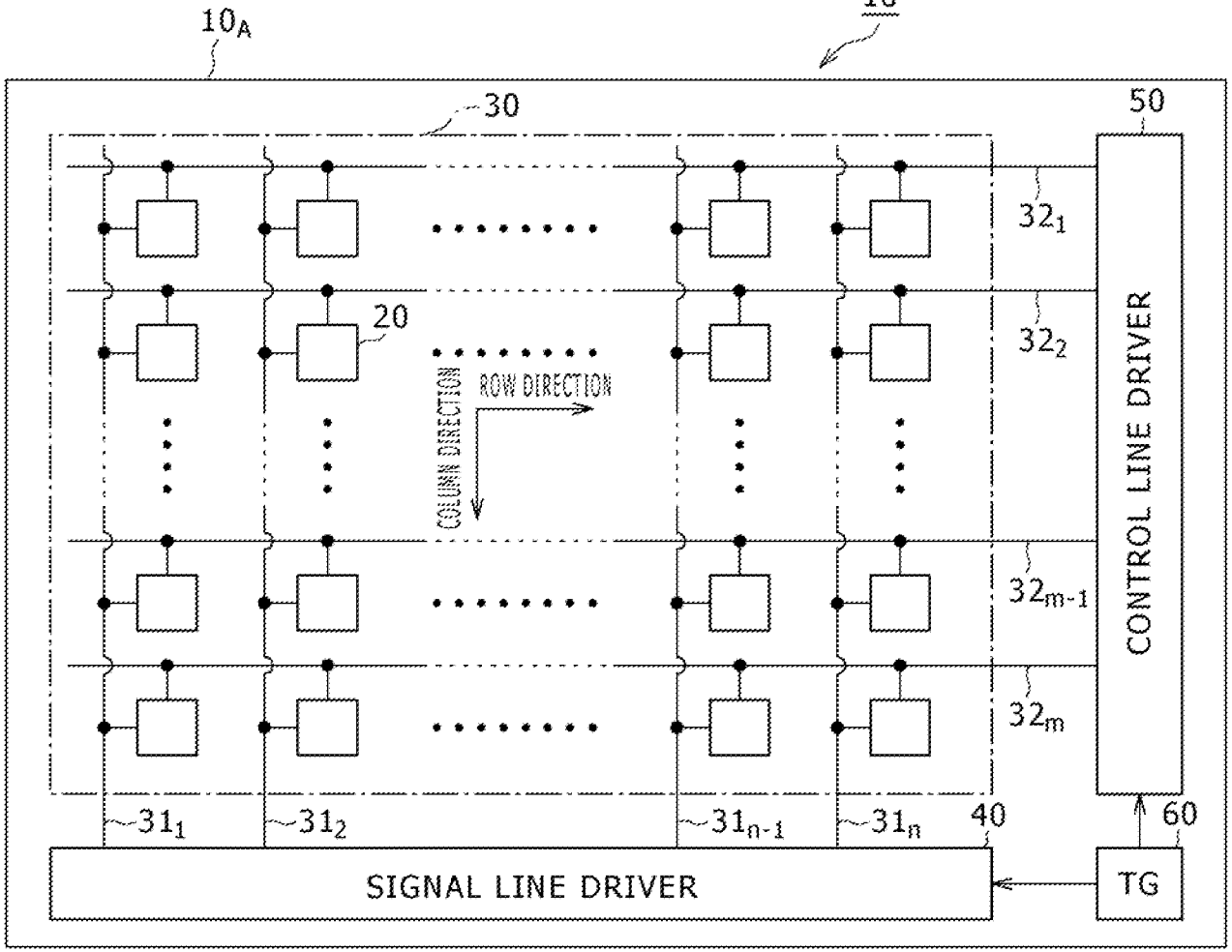
FIG. 1 is a system configuration diagram showing the outline of the configuration of an active-matrix liquid crystal display device to which an embodiment is applied.

1. Liquid Crystal Display Device to Which Embodiment Is Applied 1-1. System Configuration FIG. 1 is a system configuration diagram showing the outline of the configuration of an active-matrix liquid crystal display device to which an embodiment is applied. The liquid crystal display device exemplified with this configuration has a panel structure in which two substrates (not shown) at least one of which is transparent are disposed opposed to each other with a predetermined interval and a liquid crystal is enclosed between these two substrates.

A liquid crystal display device 10 according to the present application example has plural pixels 20 including liquid crystal capacitance, a pixel array unit 30 obtained by two-dimensionally arranging the pixels 20 in a matrix manner, and a drive unit disposed in the periphery of the pixel array unit 30. This drive unit is composed of a signal line driver 40, a control line driver 50, a drive timing generator 60, and so forth. The drive unit is integrated on the same substrate (liquid crystal display panel $\mathbf{10}_A$) as that of the pixel array unit 30 and drives the respective pixels 20 in the pixel array unit 30 for example.

If the liquid crystal display device 10 is capable of color displaying, one pixel is composed of plural sub-pixels and each of the sub-pixels is equivalent to the pixel 20. Specifically, in a liquid crystal display device for color displaying, one pixel is composed of three sub-pixels, i.e. a sub-pixel of red (R) light, a sub-pixel of green (G) light, and a sub-pixel of blue (B) light.

However, the configuration of one pixel is not limited to the combination of the sub-pixels of three primary colors of RGB and it is also possible to configure one pixel by adding a sub-pixel of one or plural colors to the sub-pixels of three primary colors. Specifically, for example, it is also possible to configure one pixel by adding a sub-pixel of while light for luminance enhancement or configure one pixel by adding at least one sub-pixel of complementary-color light in order to enlarge the color reproduction range.

The liquid crystal display device 10 according to the present application example has a built-in memory in the pixel 20 and has such a configuration as to be capable of both displaying by the analog display mode and displaying by the memory display mode. Also as described above, the analog display mode refers to a display mode in which the grayscale of the pixel is displayed in an analog manner. The memory display mode refers to a display mode in which the grayscale of the pixel is displayed in a digital manner based on binary information (logic "1"/"0") stored in the memory in the pixel.

In the memory display mode, it is unnecessary to carry out operation of writing the signal potential reflecting the grayscale with the frame cycle because information retained in the memory is used. Therefore, the memory display mode has an advantage that the power consumption is lower than that in the analog display mode, in which it is necessary to carry out operation of writing the signal potential reflecting the grayscale with the frame cycle.

In FIG. 1, for the pixel arrangement of m rows and n columns in the pixel array unit 30, signal lines $\mathbf{31}_1$ to $\mathbf{31}_n$ (hereinafter, often referred to simply as "signal line 31") are provided along the column direction on each pixel column basis. Furthermore, control lines $\mathbf{32}_1$ to $\mathbf{32}_m$ (hereinafter, often referred to simply as "control line 32") are provided along the row direction on each pixel row basis. The column direction refers to the arrangement direction of the pixels on a pixel column (i.e. vertical direction), and the row direction refers to the arrangement direction of the pixels on a pixel row (i.e. horizontal direction).

One end of each of the signal lines $\mathbf{31}_1$ to $\mathbf{31}_n$ is connected to a respective one of the output terminals of the signal line driver 40 corresponding to the columns. The signal line driver 40 operates to output the signal potential reflecting an arbitrary grayscale (analog potential $V_{sig}$ in the analog display mode or the binary potential $V_{XCS}$ in the memory display mode) to the corresponding signal line 31. Furthermore, for example even in the memory display mode, the signal line driver 40 operates to output the signal potential reflecting the necessary grayscale to the corresponding signal line 31 in the case of changing the logic level of the signal potential held in the pixel 20.

In FIG. 1, each of the control lines $\mathbf{32}_1$ to $\mathbf{32}_m$ is shown as one line. However, the number of control lines per one row is not limited to one. Actually, each of the control lines $\mathbf{32}_1$ to $\mathbf{32}_m$ is composed of plural lines. One end of each of the control lines $\mathbf{32}_1$ to $\mathbf{32}_m$ is connected to a respective one of the output terminals of the control line driver 50 corresponding to the rows. For example in the analog display mode, the control line driver 50 controls the operation of writing, to the pixel 20, the signal potential that is output from the signal line driver 40 to the signal lines $\mathbf{31}_1$ to $\mathbf{31}_n$ and reflects the grayscale.

In the liquid crystal display device 10 according to the present application example, a DRAM is used as the built-in memory in the pixel 20. It is known that the structure of the DRAM is simpler than that of the SRAM. However, in the case of the DRAM, the memory needs to be refreshed for data retention. So, the control line driver 50 carries out control for refresh operation and rewriting operation for the signal potential held in the pixel 20 (details thereof will be described later).

The drive timing generator (timing generator (TG)) 60 supplies the signal line driver 40 and the control line driver 50 with various kinds of drive pulses (timing signals) for driving these drivers 40 and 50.

1-2. Panel Sectional Structure

Figure 2:
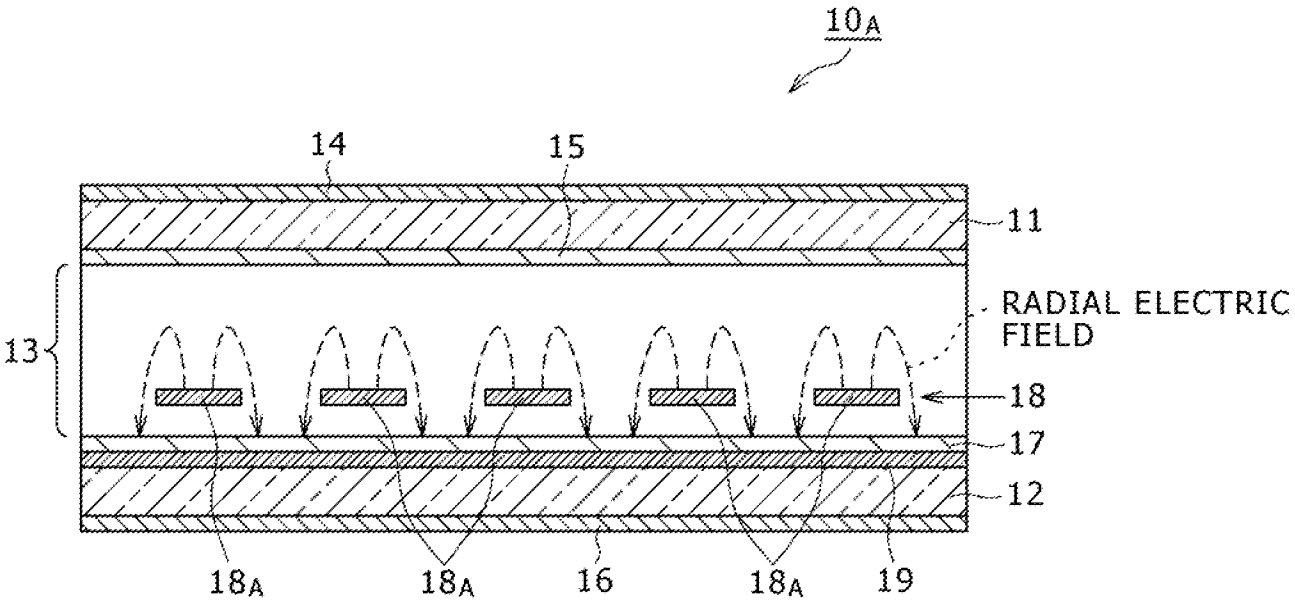
FIG. 2 is a sectional view showing one example of the sectional structure of a liquid crystal display panel (liquid crystal display device)

FIG. 2 is a sectional view showing one example of the sectional structure of the liquid crystal display panel (liquid crystal display device). As shown in FIG. 2, the liquid crystal display panel $\mathbf{10}_A$ has two glass substrates 11 and 12 provided opposed to each other with a predetermined interval and a liquid crystal layer 13 enclosed between these glass substrates 11 and 12.

A polarizer 14 is provided on the outside surface of one glass substrate 11 and an alignment film 15 is provided on the inside surface thereof. Similarly, also for the other glass substrate 12, a polarizer 16 is provided on the outside surface and an alignment film 17 is provided on the inside surface. The alignment films 15 and 17 are films for making the liquid crystal molecule group of the liquid crystal layer 13 be aligned along a certain direction. In general, a polyimide film is used as the alignment films 15 and 17.

Over the other glass substrate 12, a pixel electrode 18 and a counter electrode 19 are formed by a transparent electrically-conductive film. In this structure example, the pixel electrode 18 has e.g. five electrode branches $\mathbf{18}_A$ processed into a comb-teeth shape and both ends of these electrode branches $\mathbf{18}_A$ are connected by a connecting part (not shown). The counter electrode 19 is formed closer to the lower side (closer to the glass substrate 12) than the electrode branches $\mathbf{18}_A$ in such a manner as to cover the whole area of the pixel array unit 30.

Due to the electrode structure by the pixel electrode 18 having the comb-teeth shape and the counter electrode 19, a parabolic electric field is generated between the electrode branches 18A and the counter electrode 19 as shown by the dashed lines in FIG. 2. This can give the influence of the electric field also to the area on the upper surface side of the pixel electrode 18. Thus, the liquid crystal molecule group of the liquid crystal layer 13 can be oriented to the desired alignment direction across the whole area of the pixel array unit 30.

2. Description of Liquid Crystal Display Device According to Embodiment

Figure 3:
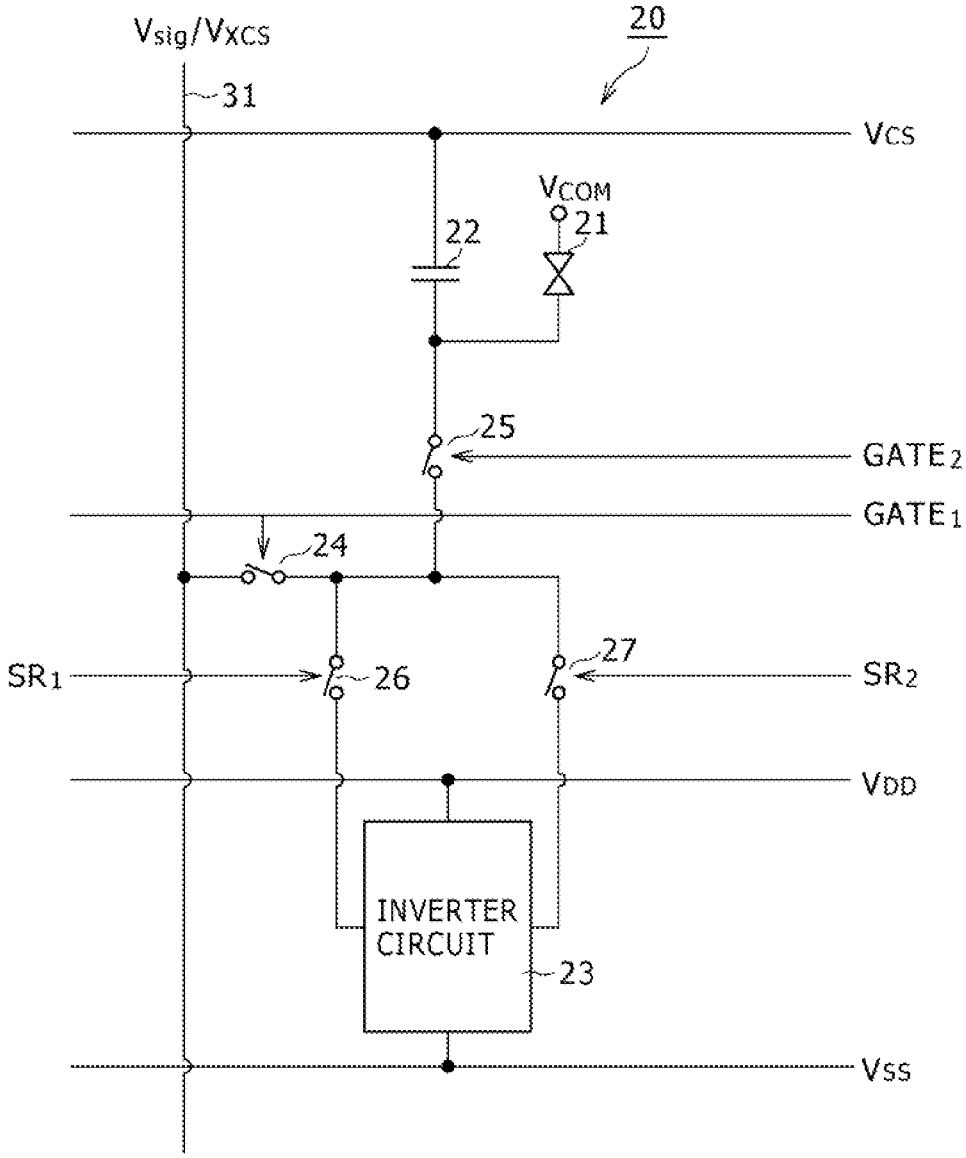
FIG. 3 is a circuit diagram showing a circuit configuration example of a pixel according to one embodiment.

In the active-matrix liquid crystal display device 10 having the above-described configuration, the present embodiment is the specific configuration of the pixel 20 that includes a built-in memory and is capable of both displaying by the analog display mode and displaying by the memory display mode. FIG. 3 shows a circuit configuration example of the pixel 20 according to the present embodiment.

As shown in FIG. 3, the pixel 20 according to the present embodiment has liquid crystal capacitance 21, a capacitive element 22, an inverter circuit 23, and first to fourth switch elements 24 to 27, and the capacitive element 22 is utilized as a DRAM. In general, it is known that the structure of the DRAM is simpler than that of the SRAM. Therefore, using the DRAM as the built-in memory enables simplification of the pixel structure and thus is advantageous over the case of using the SRAM in microminiaturization of the pixel 20.

The liquid crystal capacitance 21 means the capacitance generated on each pixel basis between the pixel electrode (equivalent to the pixel electrode 18 in FIG. 2) and the counter electrode (equivalent to the counter electrode 19 in FIG. 2) formed opposed to the pixel electrode. A common potential $V_{COM}$ is given to the counter electrode of the liquid crystal capacitance 21 in common to all pixels. The pixel electrode of the liquid crystal capacitance 21 is electrically connected to one electrode of the capacitive element 22 in common.

The capacitive element 22 holds the signal potential (analog potential $V_{sig}$ or binary potential $V_{XCS}$) that reflects the grayscale and is written from the signal line 31 (31$_1$ to 31$_n$) by writing operation to be described later. Hereinafter, the capacitive element 22 will be referred to as the holding capacitance 22. To the other electrode of the holding capacitance 22, a potential (hereinafter, referred to as "CS potential") $V_{CS}$ serving as the basis of the signal potential held by the holding capacitance 22 is given. The CS potential $V_{CS}$ is set to almost the same potential as the common potential $V_{COM}$. The holding capacitance 22 is used as a DRAM in the memory display mode.

One terminal of the first switch element 24 is connected to the signal line 31 and the first switch element 24 is in the on-(closed) state in a first operating mode in which the signal potential ($V_{sig}/V_{XCS}$) reflecting the grayscale, given via this signal line 31, is written to the holding capacitance 22. That is, the first switch element 24 is set to the on-state in the first operating mode to thereby write (capture) the signal potential ($V_{sig}/V_{XCS}$) in the pixel 20.

The first switch element 24 is in the off-(opened) state in a second operating mode in which the potential held in the holding capacitance 22 (hereinafter, referred to as "held potential") is read out and then the polarity of the held potential is inverted by the inverter circuit 23 and the inverted potential is written to the holding capacitance 22 again. The on/off-state of the first switch element 24 is controlled by a control signal $GATE_1$.

One terminal of the second switch element 25 is connected to the other terminal of the first switch element 24, and the other terminal of the second switch element 25 is connected to one electrode of the holding capacitance 22 and the pixel electrode of the liquid crystal capacitance 21. The second switch element 25 is in the on-(closed) state in the first operating mode and the period of reading of the held potential from the holding capacitance 22 and the period of rewriting of the inverted potential to the holding capacitance 22 in the second operating mode. The second switch element 25 is in the off-(opened) state in the other period. The on/off-state of the second switch element 25 is controlled by a control signal $GATE_2$.

One terminal of the third switch element 26 is connected to the other terminal of the first switch element 24 (one terminal of the second switch element 25), and the third switch element 26 is in the off-(opened) state in the first operating mode. Furthermore, the third switch element 26 is set to the on-(closed) state in the reading period in the second operating mode to thereby read out the held potential from the holding capacitance 22 via the second switch element 25 and give the held potential to the input terminal of the inverter circuit 23. The on/off-state of the third switch element 26 is controlled by a control signal $SR_1$.

The input terminal of the inverter circuit 23 is connected to the other terminal of the third switch element 26. In the reading period in the second operating mode, the inverter circuit 23 inverts the polarity of the held potential read out from the holding capacitance 22 via the second and third switch elements 25 and 26, i.e. inverts the logic.

One terminal of the fourth switch element 27 is connected to the other terminal of the first switch element 24 (one terminal of the second switch element 25) and the other terminal of the fourth switch element 27 is connected to the output terminal of the inverter circuit 23. The fourth switch element 27 is in the off-(opened) state in the first operating mode. Furthermore, the fourth switch element 27 is set to the on-(closed) state in the rewriting period in the second operating mode to thereby write the inverted potential obtained by polarity inversion by the inverter circuit 23 to the holding capacitance 22 via the second switch element 25 (rewriting). The on/off-state of the fourth switch element 27 is controlled by a control signal $SR_2$.

The control signals $GATE_1$, $GATE_2$, $SR_1$, and $SR_2$ for controlling the on/off-state of the switch elements 24 to 27 are properly output from the control line driver 50 under timing control by the drive timing generator 60 in FIG. 1.

In the liquid crystal display device 10 according to the present embodiment with the above-described configuration, the third switch element 26 and the fourth switch element 27 are in the off-state in the first operating mode. Therefore, due to setting of the first switch element 24 and the second switch element 25 to the on-state, the signal potential (analog potential $V_{sig}$ or binary potential $V_{XCS}$) reflecting the grayscale is written from the signal line 31 to the holding capacitance 22 via these first and second switch elements 24 and 25. That is, the first operating mode is an operating mode of carrying out operation of writing the signal potential ($V_{sig}/V_{XCS}$) reflecting the grayscale from the signal line 31 to the holding capacitance 22.

In the second operating mode, the first switch element 24 is in the off-state. In this state, the second switch element 25 and the third switch element 26 are set to the on-state whereas the fourth switch element 27 is kept at the off-state. At this time, the held potential of the holding capacitance 22 is read out via the second switch element 25 and the third switch element 26 and given to the input terminal of the inverter circuit 23.

The inverter circuit 23 inverts the polarity of the held potential of the holding capacitance 22 and outputs the inverted potential. Thereafter, the third switch element 26 enters the off-state and the fourth switch element 27 enters the on-state. The fourth switch element 27 writes the inverted potential of the inverter circuit 23 to the holding capacitance 22 via the second switch element 25 (rewriting operation). That is, the second operating mode is an operating mode of carrying out operation of reading out the held potential of the holding capacitance 22 and performing polarity inversion (logic inversion) by the inverter circuit 23 to write the inverted potential to the holding capacitance 22 again.

So-called refresh operation is carried out by the series of operation in this second operating mode, i.e. the reading operation of reading out the held potential from the holding capacitance 22 and the rewriting operation of writing the inverted potential obtained by inversion of the polarity of this held potential to the holding capacitance 22 again. This refresh operation is carried out in such a state that the pixel 20 is isolated from the signal line 31 due to the operation of the first switch element 24. Therefore, the signal line 31 having high load capacitance is neither charged nor discharged in the refresh operation.

That is, according to the above-described pixel configuration, the power consumption accompanying the refresh operation can be suppressed because charge and discharge of the signal line 31 having high load capacitance are unnecessary in the refresh operation. Furthermore, in the refresh operation, the operation of inverting the polarity of the potential held in the holding capacitance 22 is repeated with the repetition cycle of the second operating mode (e.g. one-frame cycle) due to the operation of the inverter circuit 23. As a result, in a liquid crystal display device driven with inversion of the polarity of the voltage applied to the liquid crystal with the one-frame cycle, the potential relationship between the pixel electrode and the counter electrode can be continued to be kept at a proper state in the memory display mode.

As described above, in the liquid crystal display device 10 that utilizes the holding capacitance 22 to hold the signal potential ($V_{sig}/V_{XCS}$) reflecting the grayscale as a DRAM and is capable of both displaying by the analog display mode and displaying by the memory display mode, a main characteristic of a first embodiment is to employ the following configuration.

Specifically, before the start of the reading period for reading out the held potential from the holding capacitance 22 in the second operating mode, the input potential of the inverter circuit 23 is set to the middle potential in the operating supply voltage range of the inverter circuit 23 for the pixel 20. The operating supply voltage range of the inverter circuit 23 refers to the voltage range between the positive-side supply potential $V_{DD}$ and the negative-side supply potential $V_{SS}$, which are the operating supply potentials of the inverter circuit 23.

The middle potential in the operating supply voltage range of the inverter circuit 23 is a potential given by $(V_{DD}-V_{SS})/2$. The concept of the term "middle potential" used here encompasses the voltage corresponding to the operating point of the inverter circuit to be described later for operation example 2 as well as the potential that is exactly the same as the potential given by $(V_{DD}-V_{SS})/2$. In addition, the existence of slight variation of e.g. about ±0.3 V attributed to various factors is also encompassed in the concept of the middle potential, of course.

If the third switch element 26 becomes the off-state, the input terminal of the inverter circuit 23 becomes the floating state. Therefore, the input capacitance of the inverter circuit 23 should be set high to some extent in order to keep the input potential for a certain period and suppress the lowering of the input potential due to e.g. leakage current. If the input stage of the inverter circuit 23 is formed of e.g. a CMOS inverter, the input capacitance is determined by the channel width W, the channel length L, the gate capacitance COX per unit area, and so forth of the PchMOS transistor and the NchMOS transistor configuring this CMOS inverter.

The input capacitance of the inverter circuit 23 is decided based on the channel width W, the channel length L, the gate capacitance COX per unit area, and so forth of the PchMOS transistor and the NchMOS transistor in such a manner that the capacitance ratio with respect to the holding capacitance 22 is about 1 to 10. The capacitance ratio of the input capacitance of the inverter circuit 23 to the holding capacitance 22 encompasses the existence of slight variation that yields some difference from 1 to 10 attributed to various factors such as variation among the elements as well as exactly 1 to 10.

A consideration will be made below about the case in which the middle potential is not given to the input terminal of the inverter circuit 23 before the start of the period of reading of the held potential from the holding capacitance 22. In this case, capacitance distribution occurs between the holding capacitance 22 and the input capacitance of the inverter circuit 23 in application of the held potential of the holding capacitance 22 to the input terminal of the inverter circuit 23.

Specifically, if the potential difference between the applied held potential and the input potential of the inverter circuit 23 before the application is large, the capacitance distribution occurs in application of the held potential of the holding capacitance 22 to the input terminal of the inverter circuit 23. Due to this capacitance distribution, the input potential of the inverter circuit 23 is lowered by the potential dependent on the capacitance ratio between the holding capacitance 22 and the input capacitance of the inverter circuit 23. Thus, the operating margin of the inverter circuit 23 becomes smaller.

In contrast, if the input potential of the inverter circuit 23 is set to the middle potential before the start of the period of reading of the held potential from the holding capacitance 22, the potential difference between the applied held potential and the input potential of the inverter circuit 23 before the application becomes smaller than that when the input potential is not set to the middle potential. Due to this feature, in application of the held potential of the holding capacitance 22 to the input terminal of the inverter circuit 23, the amount of lowering of the input potential of the inverter circuit 23 due to the capacitance distribution can be suppressed to a value smaller than that when the middle potential is not given. As a result, the operating margin of the inverter circuit 23 and hence the DRAM can be improved (enlarged) compared with the case in which the middle potential is not given.

As described above, in the pixel 20 according to the present embodiment, charge and discharge of the signal line 31 having high load capacitance are unnecessary in refresh operation in a configuration in which the holding capacitance 22 is utilized as a DRAM for simplification of the pixel structure. Therefore, the power consumption accompanying the refresh operation can be suppressed.

Furthermore, the middle potential in the operating supply voltage range of the inverter circuit 23 is given to the input terminal of the inverter circuit 23 before the held potential is read out from the holding capacitance 22 in the second operating mode. This can suppress the lowering of the input potential of the inverter circuit 23 due to capacitance distribution. Therefore, the operating margin of the inverter circuit 23 and hence the operating margin of the DRAM can be improved compared with the case in which the middle potential is not given.

In a second embodiment, a configuration to perform driving for the following operation is employed. Specifically, for the pixel 20, for a certain period after writing of the inverted potential by the fourth switch element 27, a supply potential is given from the signal line 31 to the input terminal of the inverter circuit 23 via the first switch element 24 and the third switch element 26. This driving is performed by the control line driver 50, which generates the control signal $GATE_1$ and the control signal $SR_1$ for controlling the on/off-state of the first and third switch elements 24 and 26. That is, the control line driver 50 serves as the driver to perform the above-described driving.

For giving the supply potential from the signal line 31, the signal line driver 40 in FIG. 1 operates to properly output this supply potential to the signal line 31 besides the signal potential (analog potential $V_{sig}$/binary potential $V_{XCS}$) reflecting the grayscale.

The term "supply potential" used here refers to the positive-side supply potential $V_{DD}$ and the negative-side supply potential $V_{SS}$ basically. The ground potential is also encompassed in the negative-side supply potential $V_{SS}$, of course. Furthermore, the concept of the "supply potential" encompasses such a potential that the flow of the through current to be described later due to the supply of this potential as the input of the inverter circuit does not occur as well as the potential that is exactly the same as the supply potential $V_{DD}$ or the supply potential $V_{SS}$ (ground potential). In addition, the existence of slight variation of e.g. about ±0.3 V attributed to various factors is also encompassed in the concept of the "supply potential," of course.

Moreover, the common potential $V_{COM}$ applied to the counter electrode of the liquid crystal capacitance 21 and the CS potential $V_{CS}$ applied to the other electrode of the holding capacitance 22 are generally set to the supply potential $V_{DD}$. Therefore, the common potential $V_{COM}$ and the CS potential $V_{CS}$ and furthermore the inverted potentials $XV_{COM}$ and $XV_{CS}$ thereof are also encompassed in the concept of the "supply potential."

By the way, after the inversion operation of the inverter circuit 23, the third switch element 26 is in the off-state and the input terminal of the inverter circuit 23 is in the floating state. Therefore, the input potential of the inverter circuit 23 is in an unsettled state. If the input potential of the inverter circuit 23 is in an unsettled state, possibly the input potential surpasses the threshold of the input stage of the inverter circuit 23. As a result, the through current flows through the inverter circuit 23 and thus increase in the power consumption is caused.

In contrast, the input potential of the inverter circuit 23 is settled to a supply potential by giving the supply potential from the signal line 31 to the input terminal of the inverter circuit 23 via the first and third switch elements 24 and 26 for a certain period after writing of the inverted potential by the fourth switch element 27. This prevents the occurrence of the state in which the input potential surpasses the threshold of the input stage of the inverter circuit 23. As a result, the flow of the through current through the inverter circuit 23 is avoided and thus the power consumption can be further suppressed.

If the input stage of the inverter circuit 23 is formed of e.g. a PchMOS transistor, it is preferable to give, to the input terminal of the inverter circuit 23, the positive-side supply potential $V_{DD}$, the common potential $V_{COM}$, or the CS potential $V_{CS}$ as the supply potential. If the input stage of the inverter circuit 23 is formed of e.g. an NchMOS transistor, it is preferable to give, to the input terminal of the inverter circuit 23, the negative-side supply potential $V_{SS}$, the inverted potential $XV_{COM}$ of the common potential $V_{COM}$, or the inverted potential $XV_{CS}$ of the CS potential $V_{CS}$ as the supply potential. In either case, the MOS transistor at the input stage can be surely set to the non-conductive state and thus the flow of the through current through the inverter circuit 23 can be avoided.

If the input stage of the inverter circuit 23 is formed of e.g. a CMOS inverter, as the supply potential, the positive-side supply potential $V_{DD}$, $V_{COM}$, or $V_{CS}$ may be given or the negative-side supply potential $V_{SS}$, $XV_{COM}$, or $XV_{CS}$ may be given. Giving the positive-side supply potential $V_{DD}$, $V_{COM}$, or $V_{CS}$ surely sets the PchMOS transistor of the CMOS inverter to the non-conductive state, and giving the negative-side supply potential $V_{SS}$, $XV_{COM}$, or $XV_{CS}$ surely sets the NchMOS transistor of the CMOS inverter to the non-conductive state. That is, no matter whether the positive-side or negative-side supply potential is given, the flow of the through current through the inverter circuit 23 can be avoided.

Furthermore, if the input stage of the inverter circuit 23 is formed of e.g. a CMOS inverter, the intended aim can be achieved by giving a potential that surely sets one of the transistors configuring the CMOS inverter to the non-conductive state even if the supply potential is not given. Specifically, when the positive-side supply potential of the inverter circuit 23 is $V_{DD}$ and the threshold voltage of the PchMOS transistor is $V_{thp}$, the PchMOS transistor can be surely set to the non-conductive state by giving a potential equal to or higher than ($V_{DD}-V_{thp}$). Alternatively, when the negative-side supply potential is $V_{SS}$ and the threshold voltage of the NchMOS transistor is $V_{thn}$, the NchMOS transistor can be surely set to the non-conductive state by giving a potential equal to or lower than ($V_{SS}+V_{thn}$). Therefore, the flow of the through current through the inverter circuit 23 can be avoided by settling the input potential of the inverter circuit 23 to a potential equal to or higher than ($V_{DD}-V_{thp}$) or a potential equal to or lower than ($V_{SS}+V_{thn}$).

It is possible to employ a configuration in which the inverter circuit 23 is provided for each pixel 20 based on a one-to-one correspondence relationship (pixel configuration example 1). Alternatively, it is also possible to employ a configuration in which one inverter circuit 23 is provided (shared) in common to the plural pixels 20 (pixel configuration example 2). Pixel configuration examples 1 and 2 will be specifically described below.

2-1. Pixel Configuration Example 1

Figure 4:
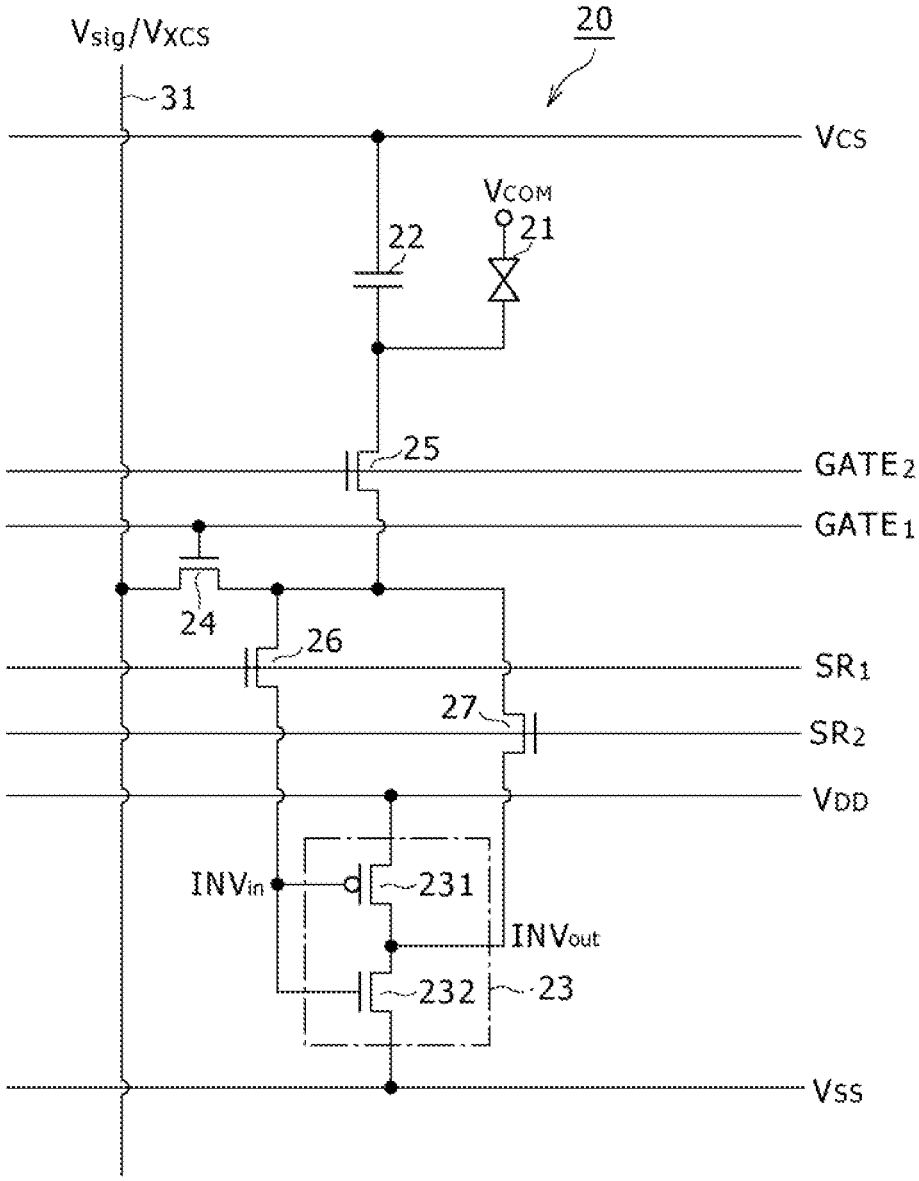
FIG. 4 is a circuit diagram showing a pixel circuit according to pixel configuration example 1.

FIG. 4 is a circuit diagram showing a pixel circuit according to pixel configuration example 1. In FIG. 4, the part equivalent to that in FIG. 3 is given the same symbol. The pixel circuit according to pixel configuration example 1 is a circuit configuration example in which the inverter circuit 23 is provided for each pixel 20 based on a one-to-one correspondence relationship.

Circuit Configuration

In the pixel circuit according to pixel configuration example 1, e.g. thin film transistors are used as the first to fourth switch elements 24 to 27. Hereinafter, the first to fourth switch elements 24 to 27 will be referred to as the first to fourth switching transistors 24 to 27. In this example, NchMOS transistors are used as the first to fourth switching transistors 24 to 27. However, it is also possible to use PchMOS transistors.

The conductive/non-conductive state of the first to fourth switching transistors 24 to 27 is controlled by the control signals $GATE_1$, $GATE_2$, $SR_1$, and $SR_2$ given to the respective gate electrodes. These control signals $GATE_1$, $GATE_2$, $SR_1$, and $SR_2$ are properly output from the control line driver 50 under timing control by the drive timing generator 60 in FIG. 1.

One main electrode (drain electrode/source electrode) of the first switching transistor 24 is connected to the signal line 31. The first switching transistor 24 is set to the conductive state when the signal potential ($V_{sig}$/$V_{XCS}$) reflecting the grayscale is written (captured) in the pixel 20 from the signal line 31 under control by the control signal $GATE_1$.

One main electrode of the second switching transistor 25 is connected to the pixel electrode of the liquid crystal capacitance 21 and one electrode of the holding capacitance 22 in common, and the other main electrode is connected to the other main electrode of the first switching transistor 24. The second switching transistor 25 is set to the conductive state when the signal potential ($V_{sig}/V_{XCS}$) reflecting the grayscale is written from the signal line 31 to the holding capacitance 22 under control by the control signal $GATE_2$.

One main electrode of the third switching transistor 26 is connected to the other main electrode of the first switching transistor 24 (the other main electrode of the second switching transistor 25), and the other main electrode of the third switching transistor 26 is connected to the input terminal of the inverter circuit 23. The third switching transistor 26 is set to the non-conductive state when the signal potential ($V_{sig}/V_{XCS}$) reflecting the grayscale is written in the pixel 20 from the signal line 31 under control by the control signal $SR_1$.

Furthermore, under control by the control signal $SR_1$, the third switching transistor 26 is set to the conductive state in a certain period immediately before the end of each frame in execution of refresh operation in the memory display mode. When the third switching transistor 26 is in the conductive state, the held potential of the holding capacitance 22 functioning as a DRAM is read out to the input terminal of the inverter circuit 23 via the second switching transistor 25 and the third switching transistor 26.

One main electrode of the fourth switching transistor 27 is connected to the other main electrode of the first switching transistor 24 (the other main electrode of the second switching transistor 25), and the other main electrode of the fourth switching transistor 27 is connected to the output terminal of the inverter circuit 23. The fourth switching transistor 27 is set to the non-conductive state when the signal potential ($V_{sig}/V_{XCS}$) reflecting the grayscale is written in the pixel 20 from the signal line 31 under control by the control signal $SR_2$.

Furthermore, under control by the control signal $SR_2$, the fourth switching transistor 27 is set to the conductive state in a certain period immediately after the start of each frame in execution of refresh operation in the memory display mode. When the fourth switching transistor 27 is in the conductive state, the signal potential that reflects the grayscale and is obtained by polarity inversion (logic inversion) by the inverter circuit 23 is written to the holding capacitance 22 via the fourth switching transistor 27 and the second switching transistor 25.

The inverter circuit 23 is formed of e.g. a CMOS inverter. Specifically, the inverter circuit 23 is composed of a PchMOS transistor 231 and an NchMOS transistor 232 connected in series between the power supply line of the supply potential $V_{DD}$ and the power supply line of the supply potential $V_{SS}$.

The gate electrodes of the PchMOS transistor 231 and the NchMOS transistor 232 are connected in common and serve as the input terminal of the inverter circuit 23. This input terminal is connected to the other main electrode of the third switching transistor 26. The drain electrodes of the PchMOS transistor 231 and the NchMOS transistor 232 are connected in common and serve as the output terminal of the inverter circuit 23. This output terminal is connected to the other main electrode of the fourth switching transistor 27.

Circuit Operation

The circuit operation of the pixel circuit according to pixel configuration example 1 having the above-described configuration will be described below for each display mode separately.

(1) Analog Display Mode

Figure 5:
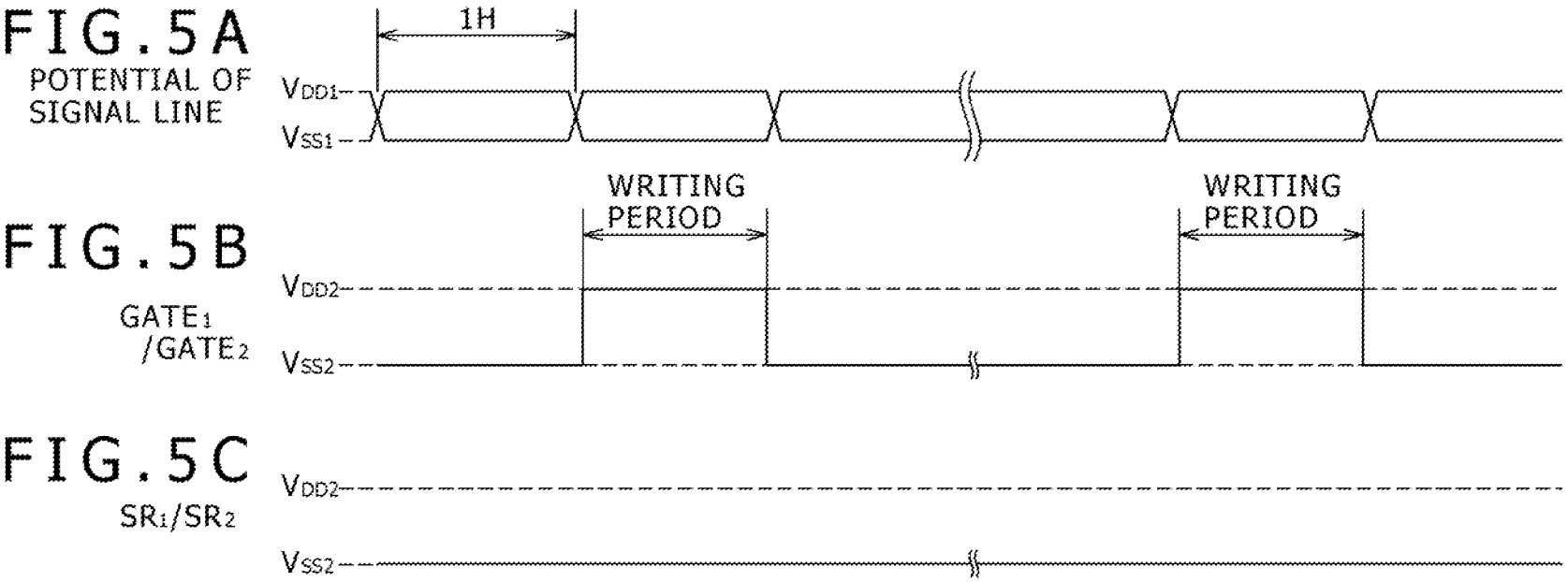
FIGS. 5A to 5C are timing waveform diagrams for explaining the operation of an analog display mode of the pixel circuit according to pixel configuration example 1.

FIGS. 5A to 5C are timing waveform diagrams for explaining the operation of the analog display mode of the pixel circuit according to pixel configuration example 1. FIGS. 5A to 5C show respectively the waveforms of FIG. 5A the potential of the signal line 31 (i.e. signal potential reflecting the grayscale), FIG. 5B the control signal $GATE_1/GATE_2$, and FIG. 5C the control signal $SR_1/SR_2$.

In the present example, the polarity of the voltage applied between the pixel electrode and counter electrode of the liquid crystal capacitance 21 is inverted with the cycle of one horizontal period (1H/one line), i.e. line inversion driving is performed. As is well known, in the liquid crystal display device, AC driving of inverting the polarity of the voltage applied to the liquid crystal about the common potential $V_{COM}$ with a certain cycle is performed in order to prevent the deterioration of e.g. the resistivity (resistance specific to the substance) of the liquid crystal due to continuation of application of a DC voltage of the same polarity to the liquid crystal.

As this AC driving, line inversion driving is performed in the present example. To realize this line inversion driving, the polarity of the signal potential reflecting the grayscale, which is the potential of the signal line 31, is inverted with the 1H cycle as shown in FIG. 5A. In the waveform of FIG. 5A, the High-side potential is $V_{DD1}$ and the Low-side potential is $V_{SS1}$. FIG. 5A shows an example of the case of the maximum swing $V_{DD1}-V_{SS1}$. Actually, the potential of the signal line 31 is at any potential level in the range of $V_{DD1}-V_{SS1}$ depending on the grayscale.

In FIG. 5B, which shows the waveform of the control signal $GATE_1/GATE_2$, the High-side potential is $V_{DD2}$ and the Low-side potential is $V_{SS2}$. The control signal $GATE_1/GATE_2$ is at the High-side potential $V_{DD2}$ in the writing period for writing the signal potential reflecting the grayscale from the signal line 31 to the holding capacitance 22.

Also in FIG. 5C, which shows the waveform of the control signal $SR_1/SR_2$, the High-side potential is $V_{DD2}$ and the Low-side potential is $V_{SS2}$. In the analog display mode, the control signal $SR_1/SR_2$ is always at the Low-side potential $V_{SS2}$.

Figure 6:
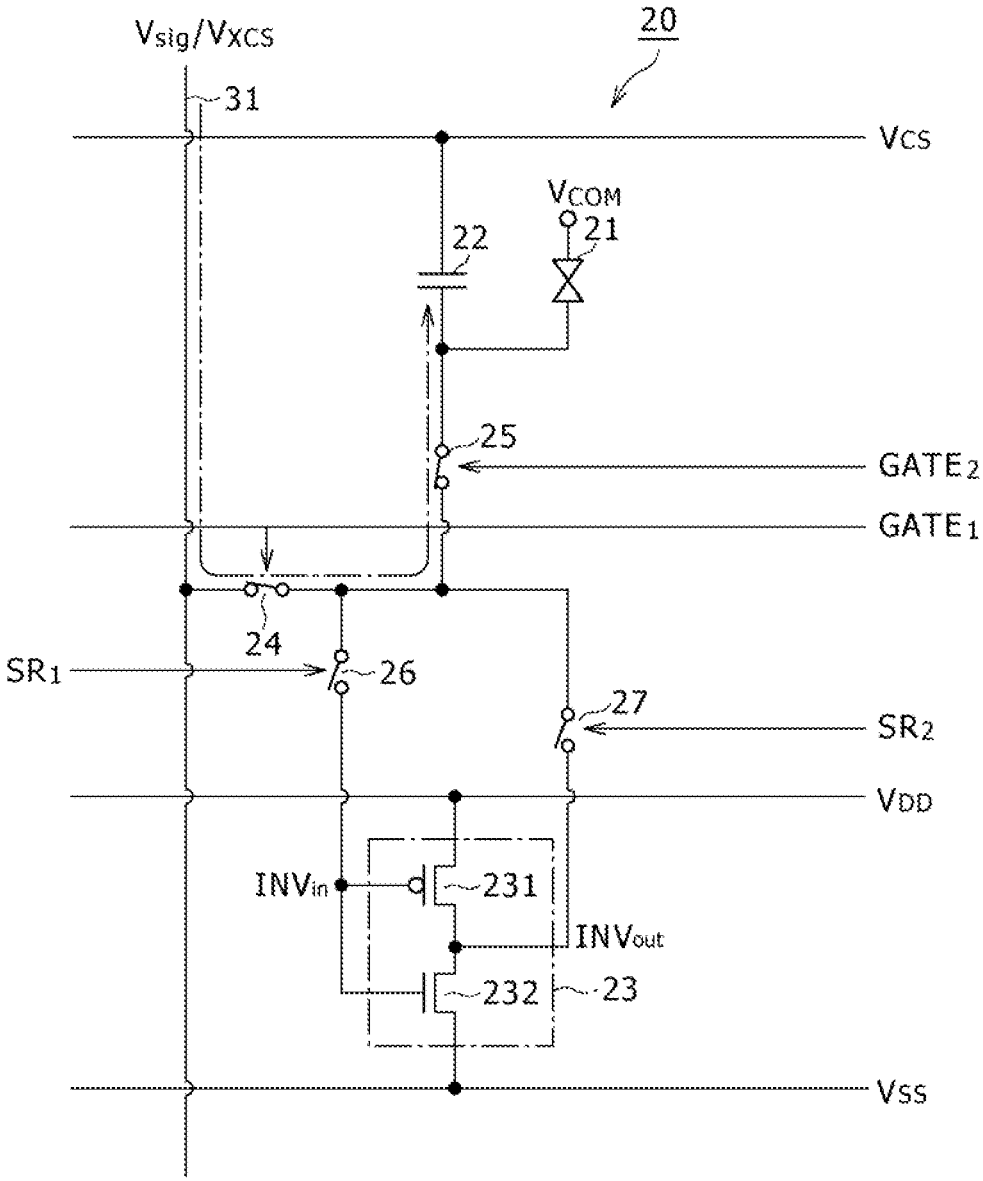
FIG. 6 is a circuit diagram showing the state in the pixel when the signal potential reflecting the grayscale is written from a signal line in the analog display mode.
Figures 7A, 7B, 7C, 7D:
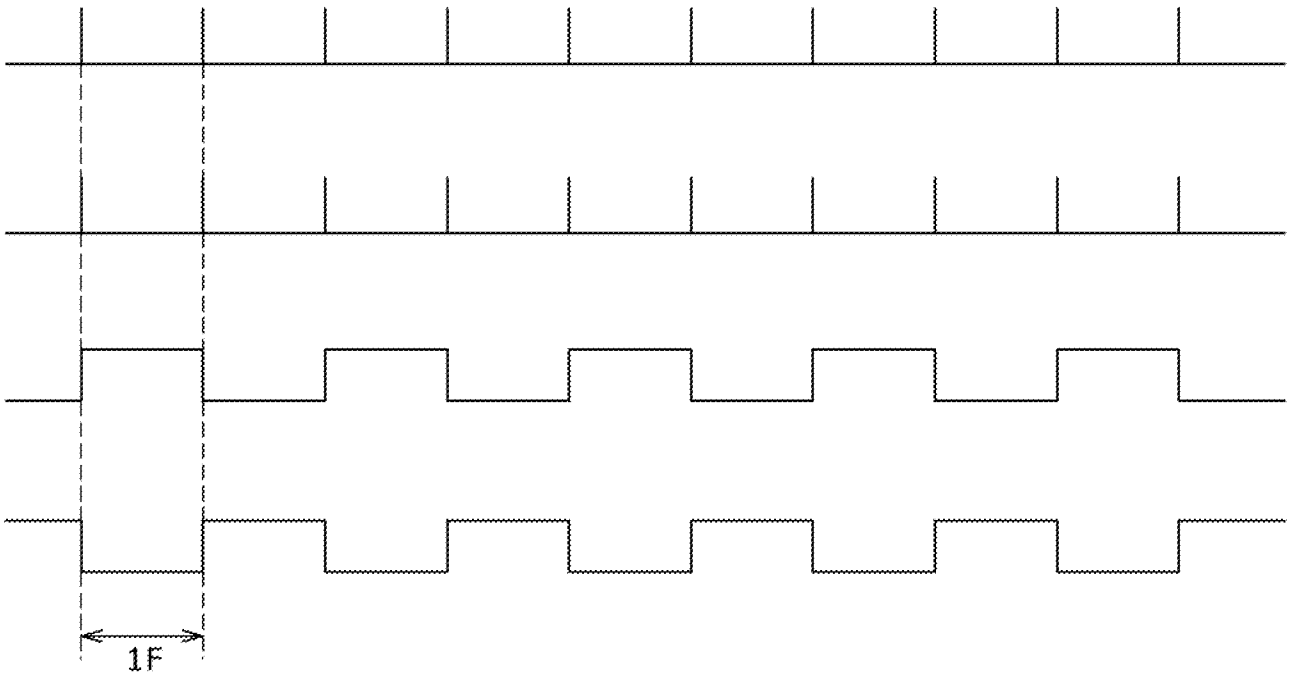
FIG. 7A to 7D are timing waveform diagrams for explaining the operation of refresh operation in a memory display mode of the pixel circuit according to pixel configuration example 1.

FIG. 6 shows the state in the pixel 20 when the signal potential reflecting the grayscale is written from the signal line 31 in the analog display mode. In FIG. 6, the first to fourth switching transistors 24 to 27 are represented by using switch symbols for facilitation of understanding.

In the period of writing of the signal potential reflecting the grayscale, both the first and second switching transistors 24 and 25 are in the conductive state (switch-closed state). On the other hand, both the third and fourth switching transistors 26 and 27 are in the non-conductive state (switch-opened state) over the whole period and electrically isolate the pixel electrode of the liquid crystal capacitance 21 and the holding capacitance 22 from the inverter circuit 23 completely. Thereby, as shown by the one-dot chain line in FIG. 6, the signal potential reflecting the grayscale is written to the holding capacitance 22 via the first switching transistor 24 and the second switching transistor 25.

(2) Memory Display Mode

In the memory display mode, writing operation of writing the signal potential reflecting the grayscale from the signal line 31 to the holding capacitance 22 and refresh operation of refreshing the held potential of the holding capacitance 22 are carried out. The writing operation is carried out e.g. in the case of changing the displayed content. The operation of writing the signal potential reflecting the grayscale from the signal line 31 to the holding capacitance 22 is the same as that in the analog display mode, and therefore description thereof is omitted.

FIGS. 7A to 7D are timing waveform diagrams for explaining the refresh operation in the memory display mode of the pixel circuit according to pixel configuration example 1, and shows the relationship of driving operation on each one frame (1F) basis. FIGS. 7A to 7D show respectively the waveforms of FIG. 7A the control signal $GATE_2$, FIG. 7B the control signal $SR_1/SR_2$, FIG. 7C the CS potential $V_{CS}$, and FIG. 7D a signal potential PIX written to the holding capacitance 22.

As is apparent from the timing waveform diagram of FIGS. 7A to 7D, in the control signal $GATE_2$ and the control signal $SR_1/SR_2$, the High-side potential arises in a pulse manner with the one-frame cycle. The CS potential $V_{CS}$ is alternately switched to the High-side potential and the Low-side potential with the one-frame cycle. The polarity of the signal potential PIX written to the holding capacitance 22 is inverted with the one-frame cycle in order to realize AC driving.

In the memory display mode, the control signal $GATE_1$ is always at the Low-side potential. Thus, the first switching transistor 24 is in the non-conductive state (switch-opened state) and electrically isolates the pixel 20 from the signal line 31.

2-2. Pixel Configuration Example 2

Figure 8:
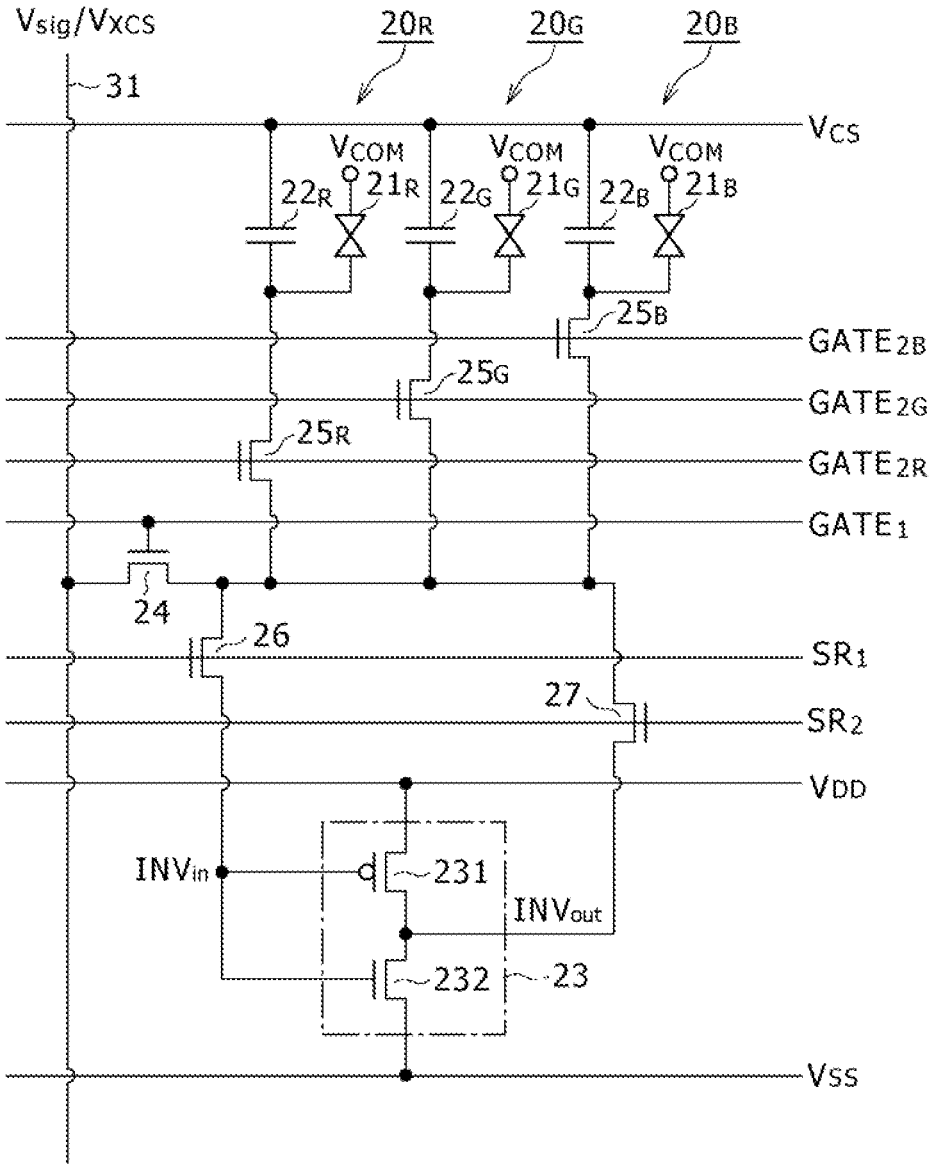
FIG. 8 is a circuit diagram showing a pixel circuit according to pixel configuration example 2.

FIG. 8 is a circuit diagram showing a pixel circuit according to pixel configuration example 2. In FIG. 8, the part equivalent to that in FIG. 4 is given the same symbol. The pixel circuit according to pixel configuration example 2 is a pixel for color displaying, and one pixel is composed of e.g. three sub-pixels $\mathbf{20}_R$, $\mathbf{20}_G$, and $\mathbf{20}_B$ of R, G, and B. Furthermore, one inverter circuit 23 is shared by three sub-pixels $\mathbf{20}_R$, $\mathbf{20}_G$, and $\mathbf{20}_B$.

Circuit Configuration

Also in the pixel circuit according to pixel configuration example 2, e.g. thin film transistors are used as the first to fourth switching transistors 24 to 27 serving as the first to fourth switch elements, similarly to the pixel circuit according to pixel configuration example 1.

The sub-pixel $\mathbf{20}_R$ corresponding to red (R) has a second switching transistor $\mathbf{25}_R$ in addition to liquid crystal capacitance $\mathbf{21}_R$ and holding capacitance $\mathbf{22}_R$. One main electrode of the second switching transistor $\mathbf{25}_R$ is connected to the pixel electrode of the liquid crystal capacitance $\mathbf{21}_R$ and one electrode of the holding capacitance $\mathbf{22}_R$ in common, and the other main electrode of the second switching transistor $\mathbf{25}_R$ is connected to the other main electrode of the first switching transistor 24. The second switching transistor $\mathbf{25}_R$ is set to the conductive state when the signal potential ($V_{sig}/V_{XCS}$) reflecting the grayscale is written to the holding capacitance $\mathbf{22}_R$ under control by a control signal $GATE_{2R}$ corresponding to red.

Similarly, the sub-pixel $\mathbf{20}_G$ corresponding to green (G) has a second switching transistor $\mathbf{25}_G$ in addition to liquid crystal capacitance $\mathbf{21}_G$ and holding capacitance $\mathbf{22}_G$. One main electrode of the second switching transistor $\mathbf{25}_G$ is connected to the pixel electrode of the liquid crystal capacitance $\mathbf{21}_G$ and one electrode of the holding capacitance $\mathbf{22}_G$ in common, and the other main electrode of the second switching transistor $\mathbf{25}_G$ is connected to the other main electrode of the first switching transistor 24. The second switching transistor $\mathbf{25}_G$ is set to the conductive state when the signal potential ($V_{sig}/V_{XCS}$) reflecting the grayscale is written to the holding capacitance $\mathbf{22}_G$ under control by a control signal $GATE_{2G}$ corresponding to green.

Similarly, the sub-pixel $\mathbf{20}_B$ corresponding to blue (B) has a second switching transistor $\mathbf{25}_B$ in addition to liquid crystal capacitance $\mathbf{21}_B$ and holding capacitance $\mathbf{22}_B$. One main electrode of the second switching transistor $\mathbf{25}_B$ is connected to the pixel electrode of the liquid crystal capacitance $\mathbf{21}_B$ and one electrode of the holding capacitance $\mathbf{22}_B$ in common, and the other main electrode of the second switching transistor $\mathbf{25}_B$ is connected to the other main electrode of the first switching transistor 24. The second switching transistor $\mathbf{25}_B$ is set to the conductive state when the signal potential ($V_{sig}/V_{XCS}$) reflecting the grayscale is written to the holding capacitance $\mathbf{22}_B$ under control by a control signal $GATE_{2B}$ corresponding to blue.

For these sub-pixels $\mathbf{20}_R$, $\mathbf{20}_G$, and $\mathbf{20}_B$, the inverter circuit 23, the first switching transistor 24, and the third and fourth switching transistors 26 and 27 are provided in common. The circuit configuration of the inverter circuit 23, the connection relationship among the first, third, and fourth switching transistors 24, 26, and 27, and the functions of these components are basically the same as those in pixel configuration example 1.

Specifically, one main electrode (drain electrode/source electrode) of the first switching transistor 24 is connected to the signal line 31. The first switching transistor 24 is set to the conductive state when the signal potential ($V_{sig}/V_{XCS}$) reflecting the grayscale is written (captured) in the pixel 20 from the signal line 31 under control by the control signal $GATE_1$.

One main electrode of the third switching transistor 26 is connected to the other main electrode of the first switching transistor 24 (the other main electrodes of the second switching transistors $\mathbf{25}_R$, $\mathbf{25}_G$, and $\mathbf{25}_B$), and the other main electrode of the third switching transistor 26 is connected to the input terminal of the inverter circuit 23. The third switching transistor 26 is set to the non-conductive state when the signal potential ($V_{sig}/V_{XCS}$) reflecting the grayscale is written in the pixel 20 from the signal line 31 under control by the control signal $SR_1$.

Furthermore, under control by the control signal $SR_1$, the third switching transistor 26 is set to the conductive state in a certain period immediately before the end of each frame in execution of refresh operation in the memory display mode. When the third switching transistor 26 is in the conductive state, the held potentials of the holding capacitances $\mathbf{22}_R$, $\mathbf{22}_G$, and $\mathbf{22}_B$ each functioning as a DRAM are read out to the input terminal of the inverter circuit 23 via the second switching transistors $\mathbf{25}_R$, $\mathbf{25}_G$, and $\mathbf{25}_B$ and the third switching transistor 26.

One main electrode of the fourth switching transistor 27 is connected to the other main electrode of the first switching transistor 24 (the other main electrodes of the second switching transistors $\mathbf{25}_R$, $\mathbf{25}_G$, and $\mathbf{25}_B$), and the other main electrode of the fourth switching transistor 27 is connected to the output terminal of the inverter circuit 23. The fourth switching transistor 27 is set to the non-conductive state when the signal potential ($V_{sig}/V_{XCS}$) reflecting the grayscale is written in the pixel 20 from the signal line 31 under control by the control signal $SR_2$.

Furthermore, under control by the control signal $SR_2$, the fourth switching transistor 27 is set to the conductive state in a certain period immediately after the start of each frame in execution of refresh operation in the memory display mode. When the fourth switching transistor 27 is in the conductive state, the signal potential that reflects the grayscale and is obtained by polarity inversion (logic inversion) by the inverter circuit 23 is written to the holding capacitances $\mathbf{22}_R$, $\mathbf{22}_G$, and $\mathbf{22}_B$ via the fourth switching transistor 27 and the second switching transistors $\mathbf{25}_R$, $\mathbf{25}_G$, and $\mathbf{25}_B$.

The inverter circuit 23 is formed of e.g. a CMOS inverter. Specifically, the inverter circuit 23 is composed of the PchMOS transistor 231 and the NchMOS transistor 232 connected in series between the power supply line of the supply potential $V_{DD}$ and the power supply line of the supply potential $V_{SS}$.

The gate electrodes of the PchMOS transistor 231 and the NchMOS transistor 232 are connected in common and serve as the input terminal of the inverter circuit 23. This input terminal is connected to the other main electrode of the third switching transistor 26. The drain electrodes of the PchMOS transistor 231 and the NchMOS transistor 232 are connected in common and serve as the output terminal of the inverter circuit 23. This output terminal is connected to the other main electrode of the fourth switching transistor 27.

Circuit Operation

The circuit operation of the pixel circuit according to pixel configuration example 2 having the above-described configuration, i.e. the sub-pixels $\mathbf{20}_R$, $\mathbf{20}_G$, and $\mathbf{20}_B$, will be described below for each display mode separately.

(1) Analog Display Mode

FIGS. 9A to 9F are timing waveform diagrams for explaining the operation of the analog display mode of the pixel circuit according to pixel configuration example 2. FIGS. 9A to 9F show respectively the waveforms of FIG. 9A the potential of the signal line 31, FIG. 9B the control signal $GATE_1$, FIG. 9C the control signal $GATE_{2R}$ corresponding to red, FIG. 9D the control signal $GATE_{2G}$ corresponding to green, FIG. 9E the control signal $GATE_{2B}$ corresponding to blue, and FIG. 9F the control signal $SR_1/SR_2$.

In the present example, the polarity of the voltage applied between the pixel electrode and counter electrode of the liquid crystal capacitances $\mathbf{21}_R$, $\mathbf{21}_G$, and $\mathbf{21}_B$ is inverted with the cycle of one horizontal period (1H/one line), i.e. line inversion driving is performed (AC driving). To realize this line inversion driving, the polarity of the signal potential reflecting the grayscale, which is the potential of the signal line 31, is inverted with the 1H cycle as shown in FIG. 9A.

In the waveform of the signal potential reflecting the grayscale, shown in FIG. 9A, the High-side potential is $V_{DD1}$ and the Low-side potential is $V_{SS1}$. FIG. 9A shows an example of the case of the maximum swing $V_{DD1}-V_{SS1}$. Actually, the potential of the signal line 31 is at any potential level in the range of $V_{DD1}-V_{SS1}$ depending on the grayscale.

In FIG. 9B, which shows the waveform of the control signal $GATE_1$, the High-side potential is $V_{DD2}$ and the Low-side potential is $V_{SS2}$. The control signal $GATE_1$ is at the High-side potential $V_{DD2}$ in the writing period for writing the signal potential reflecting the grayscale from the signal line 31 to the holding capacitances $\mathbf{22}_R$, $\mathbf{22}_G$, and $\mathbf{22}_B$.

Also in FIGS. 9C, 9D, and 9E, which show the respective waveforms of the control signals $GATE_{2R}$, $GATE_{2G}$, and $GATE_{2B}$, the High-side potential is $V_{DD2}$ and the Low-side potential is $V_{SS2}$. The control signals $GATE_{2R}$, $GATE_{2G}$, and $GATE_{2B}$ are switched to the High-side potential $V_{DD2}$ in the order of e.g. R→G→B in the writing period for writing the signal potential reflecting the grayscale from the signal line 31 to the holding capacitances $\mathbf{22}_R$, $\mathbf{22}_G$, and $\mathbf{22}_B$, i.e. in the period when the control signal $GATE_1$ is at the High-side potential $V_{DD2}$.

The periods when the control signals $GATE_{2R}$, $GATE_{2G}$, and $GATE_{2B}$ are at the High-side potential $V_{DD2}$ are so set as not to overlap with each other. In each of the periods when the control signals $GATE_{2R}$, $GATE_{2G}$, and $GATE_{2B}$ are at the High-side potential $V_{DD2}$, the signal potential $V_{sig}$ that corresponds to a respective one of the colors and reflects the grayscale is output from the signal line driver 40 in FIG. 1 to the signal line 31.

Also in FIG. 9F, which shows the waveform of the control signal $SR_1/SR_2$, the High-side potential is $V_{DD2}$ and the Low-side potential is $V_{SS2}$. The control signal $SR_1/SR_2$ is always at the Low-side potential $V_{SS2}$ in the analog display mode.

(2) Memory Display Mode

In the memory display mode, writing operation of writing the signal potential reflecting the grayscale from the signal line 31 to the holding capacitances $\mathbf{22}_R$, $\mathbf{22}_G$, and $\mathbf{22}_B$ and refresh operation of refreshing the held potentials of the holding capacitances $\mathbf{22}_R$, $\mathbf{22}_G$, and $\mathbf{22}_B$ are carried out. The writing operation is carried out e.g. in the case of changing the displayed content. The operation of writing the signal potential reflecting the grayscale from the signal line 31 to the holding capacitances $\mathbf{22}_R$, $\mathbf{22}_G$, and $\mathbf{22}_B$ is the same as that in the analog display mode, and therefore description thereof is omitted.

Figure 10A:
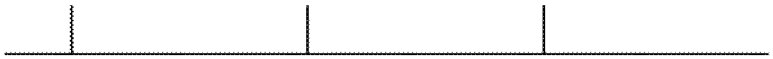
FIGS. 10A to 10H are timing waveform diagrams for explaining the operation of refresh operation in the memory display mode of the pixel circuit according to pixel configuration example 2.
Figure 10B:
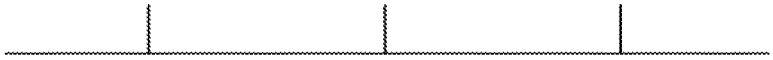
Figure 10C:
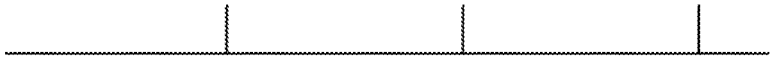
Figure 10D:
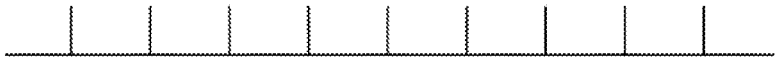
Figure 10E:
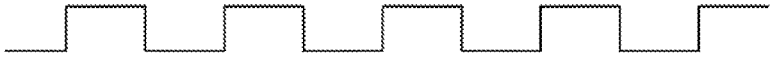
Figure 10F:
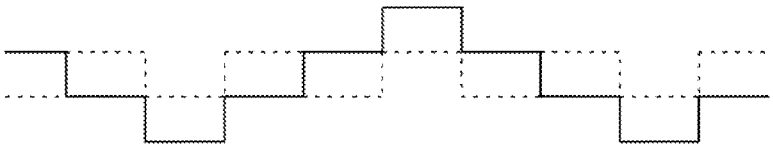
Figure 10G:
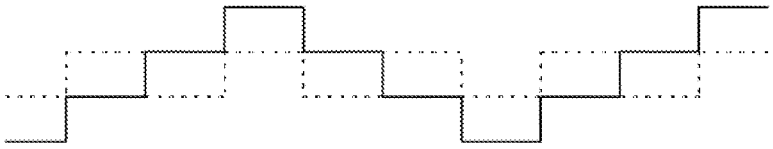
Figure 10H:
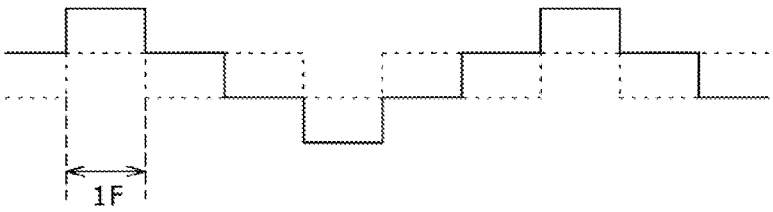

FIGS. 10A to 10H are timing waveform diagrams for explaining the refresh operation in the memory display mode of the pixel circuit according to pixel configuration example 2, and shows the relationship of driving operation on each one frame (1F) basis. FIGS. 10A to 10E respectively show the waveforms of FIG. 10A the control signal $GATE_{2R}$, FIG. 10B the control signal $GATE_{2G}$, FIG. 10C the control signal $GATE_{2B}$, FIG. 10D the control signal $SR_1/SR_2$, and FIG. 10E the CS potential $V_{CS}$. Furthermore, FIGS. 10F to 10H show respectively the waveforms of FIG. 10F a signal potential $PIX_R$ written to the holding capacitance $\mathbf{22}_R$, FIG. 10G a signal potential $PIX_G$ written to the holding capacitance $\mathbf{22}_G$, and FIG. 10H a signal potential $PIX_B$ written to the holding capacitance $\mathbf{22}_B$.

As is apparent from the timing waveform diagrams of FIGS. 10A to 10H, in the control signals $GATE_{2R}$, $GATE_{2G}$, and $GATE_{2B}$, the High-side potential arises in a pulse manner with the three-frame cycle. In the control signal $SR_1/SR_2$, the High-side potential arises in a pulse manner with the one-frame cycle. The CS potential $V_{CS}$ is alternately switched to the High-side potential and the Low-side potential with the one-frame cycle.

In FIGS. 10F, 10G, and 10H, the waveform shown by the dotted line is the waveform of the CS potential $V_{CS}$, and the waveforms shown by the solid lines are the waveforms of the signal potentials $PIX_R$, $PIX_G$, and $PIX_B$ reflecting the grayscale. Along with the change in the CS potential $V_{CS}$ with the one-frame cycle, the signal potentials $PIX_R$, $PIX_G$, and $PIX_B$ reflecting the grayscale also change with the one-frame cycle. However, the potential relationship between the CS potential $V_{CS}$ and the signal potentials $PIX_R$, $PIX_G$, and $PIX_B$ changes with the three-frame cycle.

That is, the polarity inversion operation and the refresh operation for the held potentials $PIX_R$, $PIX_G$, and $PIX_B$ of the holding capacitances $\mathbf{22}_R$, $\mathbf{22}_G$, and $\mathbf{22}_B$ of the respective colors are carried out with the three-frame cycle. Of course, the potential relationship in the sub-pixels $\mathbf{20}_R$, $\mathbf{20}_G$, and $\mathbf{20}_B$ is maintained from the previous polarity inversion operation and refresh operation to the present polarity inversion operation and refresh operation. Therefore, in the case of the present example, the holding capacitances $\mathbf{22}_R$, $\mathbf{22}_G$, and $\mathbf{22}_B$ should be such capacitance as to be capable of holding the signal potentials $PIX_R$, $PIX_G$, and $PIX_B$ reflecting the grayscale although the refresh rate is the three-frame cycle.

In the memory display mode, the control signal $GATE_1$ is always at the Low-side potential. Thus, the first switching transistor 24 is in the non-conductive state (switch-opened state) and electrically isolates each of the sub-pixels $\mathbf{20}_R$, $\mathbf{20}_G$, and $\mathbf{20}_B$ from the signal line 31.

A description will be made below about a specific operation example for giving the middle potential in the operating supply voltage range of the inverter circuit 23 to the input terminal of the inverter circuit 23 before the start of the reading period for reading out the held potential from the holding capacitance 22 in the second operating mode.

2-3. Operation Example 1

FIGS. 11A to 11H are timing waveform diagrams for explaining the operation of a driving method according to operation example 1 for giving the middle potential to the input terminal of the inverter circuit 23, specifically for explaining the operation in the memory display mode regarding a certain scan line.

The following description will be made by taking, as an example, the case of the sub-pixel $\mathbf{20}_G$ corresponding to green in the pixel circuit of the above-described pixel configuration example 2. However, operation similar to that for the sub-pixel $\mathbf{20}_G$ is carried out also for the sub-pixels $\mathbf{20}_R$ and $\mathbf{20}_B$ of the other colors and the pixel circuit of pixel configuration example 1.

Figures 11A, 11B, 11C, 11D, 11E, 11F, 11G, 11H:
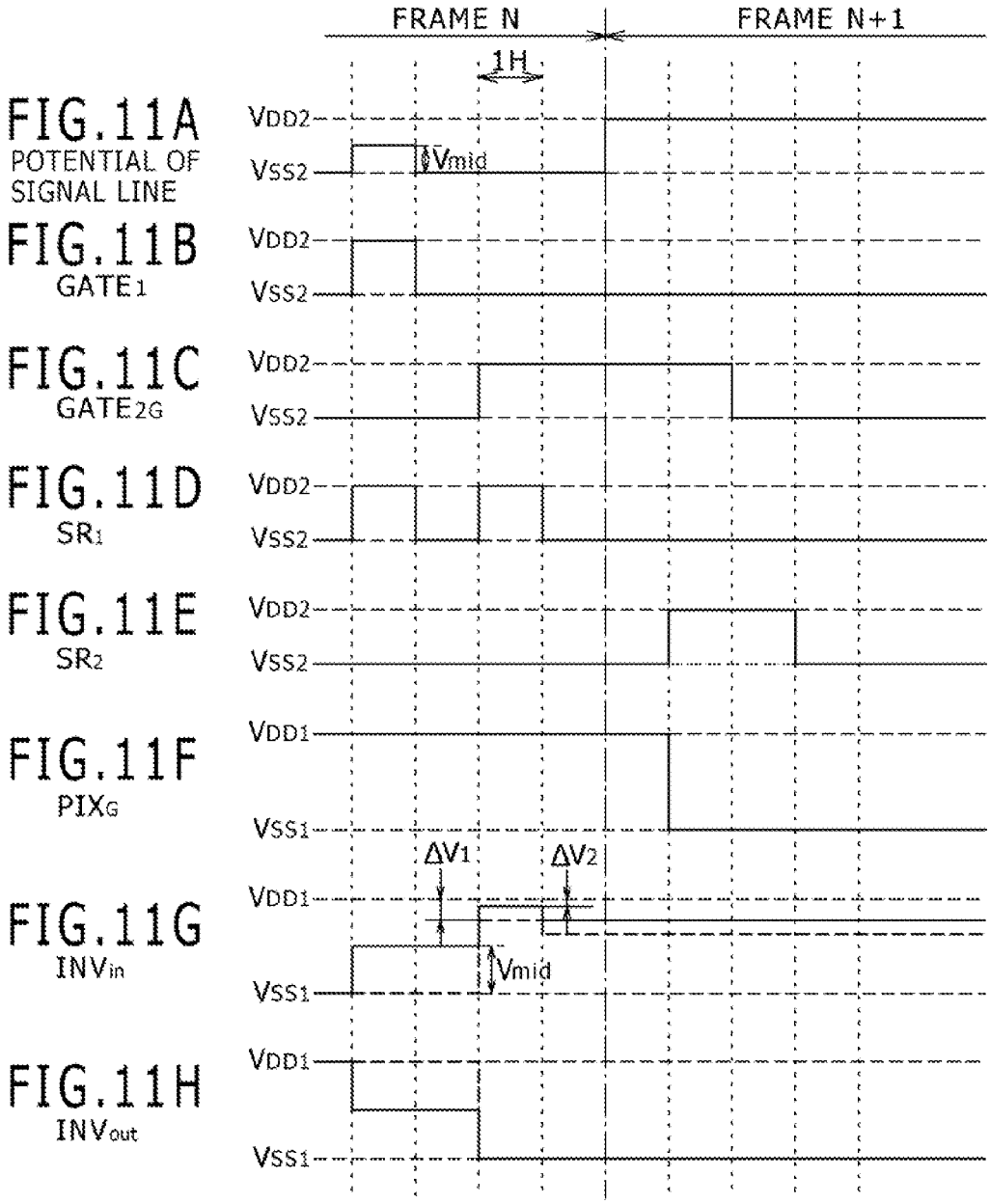
FIGS. 11A to 11H are timing waveform diagrams for explaining the operation of a driving method according to operation example 1 for giving a middle potential to the input terminal of an inverter circuit.

In FIGS. 11A to 11E, the waveforms of FIG. 11A the potential of the signal line 31, FIG. 11B the control signal $GATE_1$, FIG. 11C the control signal $GATE_{2G}$ corresponding to G, FIG. 11D the control signal $SR_1$, and FIG. 11E the control signal $SR_2$ around the boundary part of the frame in FIGS. 10A to 10H are shown in an enlarged manner. Furthermore, in FIGS. 11F to 11H, the waveforms of the potential $PIX_G$ held in the holding capacitance $\mathbf{22}_G$ (held potential), the input potential $INV_{in}$ of the inverter circuit 23, and the output potential $INV_{out}$ thereof are also shown in an enlarged manner.

In FIGS. 11A to 11H, the present frame is represented as frame N and the next frame is represented as frame N+1. In the present example, e.g. 1H is used as the unit of the pulse width of the control signals $GATE_1$, $GATE_{2G}$, $SR_1$, and $SR_2$.

The control signal $GATE_{2G}$ to control the conductive/non-conductive state of the second switching transistor $\mathbf{25}_G$ is set to the High-side potential $V_{DD2}$ during a certain period (in the present example, 4H period) from a timing immediately before (in the present example, 2H before) the end of the present frame N to a timing immediately after (in the present example, 2H after) the start of the next frame N+1. Due to the setting of the control signal $GATE_{2G}$ to the High-side potential $V_{DD2}$ and setting of the second switching transistor $\mathbf{25}_G$ to the conductive state, the second operating mode starts.

The operation that will be described below and is carried out before the start of this second operating mode is a characteristic point of operation example 1. Specifically, before (in the present example, 2H before) the start of the reading period of the second operating mode, the control signal $GATE_1$ and the control signal $SR_1$ are set to the High-side potential $V_{DD2}$ for only a certain period (in the present example, 1H period). At this time, the middle potential $V_{mid}$ in the operating supply voltage range of the inverter circuit 23 is output from the signal line driver 40 in FIG. 1 to the signal line 31.

Therefore, the first and third switching transistors 24 and 26 become the conductive state in response to the control signal $GATE_1$ and the control signal $SR_1$. Thereby, the middle potential $V_{mid}$ is written to the input terminal of the inverter circuit 23 via the first and third switching transistors 24 and 26. Thus, the input potential $INV_{in}$ of the inverter circuit 23 becomes the middle potential $V_{mid}$. After the input potential $INV_{in}$ of the inverter circuit 23 is set to the middle potential $V_{mid}$ in this manner, the control signal $GATE_{2G}$ is set to the High-side potential $V_{DD2}$ and the second switching transistor $\mathbf{25}_G$ becomes the conductive state, so that the second operating mode starts.

The control signal $SR_1$ to control the conductive/non-conductive state of the third switching transistor 26 is set to the High-side potential $V_{DD2}$ for only a certain period (in the present example, 1H period) immediately before (in the present example, 2H before) each frame, besides in the writing period of the middle potential $V_{mid}$. The control signal $SR_2$ to control the conductive/non-conductive state of the fourth switching transistor 27 is set to the High-side potential $V_{DD2}$ for only a certain period (in the present example, 2H period) immediately after (in the present example, 1H after) each frame.

Around the frame boundary part, where the control signal $GATE_{2G}$ is set to the High-side potential $V_{DD2}$ and the second switching transistor $\mathbf{25}_G$ becomes the conductive state, first the control signal $SR_1$ is set to the High-side potential $V_{DD2}$ and thereby the third switching transistor 26 becomes the conductive state. Due to this operation, the held potential $PIX_G$ of the holding capacitance $\mathbf{22}_G$ is read out via the second and third switching transistors $\mathbf{25}_G$ and 26 and given to the input terminal of the inverter circuit 23.

A consideration will be made below about the case in which the middle potential $V_{mid}$ is not given to the input terminal of the inverter circuit 23 before the start of the period of reading of the held potential $PIX_G$ from the holding capacitance $\mathbf{22}_G$. In this case, capacitance distribution occurs between the holding capacitance $\mathbf{22}_G$ and the input capacitance of the inverter circuit 23 in application of the held potential $PIX_G$ of the holding capacitance $\mathbf{22}_G$ to the input terminal of the inverter circuit 23.

Specifically, when the held potential $PIX_G$ equal to the High-side potential $V_{DD1}$ is written in the state in which the input potential $INV_{in}$ of the inverter circuit 23 is at e.g. the Low-side potential $V_{SS1}$, capacitance distribution occurs between the holding capacitance $\mathbf{22}_G$ and the input capacitance of the inverter circuit 23 because the potential difference at the timing of this writing is large. Due to this capacitance distribution, the input potential $INV_{in}$ of the inverter circuit 23 is lowered by a potential $\Delta V_1$ dependent on this potential difference and the capacitance ratio between the holding capacitance $\mathbf{22}_G$ and the input capacitance of the inverter circuit 23 as shown by the dashed line in FIG. 11G. Thus, the operating margin of the inverter circuit 23 becomes smaller.

In contrast, in the driving method according to operation example 1, the middle potential $V_{mid}$ is given to the input terminal of the inverter circuit 23 before the start of the period of reading of the held potential $PIX_G$ from the holding capacitance $\mathbf{22}_G$ as described above. Due to this feature, the potential difference between the held potential $PIX_G$ applied to the input terminal of the inverter circuit 23 and the input potential $INV_{in}$ before the application (i.e. middle potential $V_{mid}$) becomes smaller than that when the middle potential $V_{mid}$ is not given.

Therefore, in application of the held potential $PIX_G$ of the holding capacitance $\mathbf{22}_G$ to the input terminal of the inverter circuit 23, the amount $\Delta V_2$ of lowering of the input potential $INV_{in}$ of the inverter circuit 23 due to capacitance distribution can be made smaller than the amount $\Delta V_1$ of lowering when the middle potential $V_{mid}$ is not given. As a result, when the middle potential $V_{mid}$ is given to the input terminal, the operating margin of the inverter circuit 23 and hence the DRAM can be improved (enlarged) compared with the case in which the middle potential $V_{mid}$ is not given to the input terminal of the inverter circuit 23.

The inverter circuit 23 inverts the polarity (logic) of the held potential $PIX_G$ read out from the holding capacitance $\mathbf{22}_G$. By this operation of the inverter circuit 23, the input potential $INV_{in}$ ($=V_{DD1}-\Delta V_2$) is turned to the output potential $INV_{out}$ equal to the Low-side potential $V_{SS1}$ by polarity inversion. In the input and output potentials $INV_{in}$ and $INV_{out}$ of the inverter circuit 23, the High-side potential $V_{DD1}$ is equivalent to the positive-side supply potential $V_{DD}$ in FIG. 8 and the Low-side potential $V_{SS1}$ is equivalent to the negative-side supply potential $V_{SS}$.

Parasitic capacitance exists between the gate and source of the third switching transistor 26. Therefore, at the timing of the transition of the control signal $SR_1$ from the High-side potential $V_{DD2}$ to the Low-side potential $V_{SS2}$, the input potential $INV_{in}$ of the inverter circuit 23 is slightly dropped (lowered) from the potential of $(V_{DD1}-\Delta V_2)$ attributed to coupling due to this parasitic capacitance.

After the start of the next frame N+1, the control signal $SR_2$ is set to the High-side potential $V_{DD2}$ and thereby the fourth switching transistor 27 becomes the conductive state. Due to this operation, the signal potential obtained by the polarity inversion (logic inversion) by the inverter circuit 23, i.e. the output potential $INV_{out}$ of the inverter circuit 23, is written to the holding capacitance $\mathbf{22}_G$ via the fourth and second switching transistors 27 and $\mathbf{25}_G$. As a result, the polarity of the held potential $PIX_G$ of the holding capacitance $\mathbf{22}_G$ is inverted. By this series of operation, the polarity inversion operation and the refresh operation for the held potential $PIX_G$ of the holding capacitance $\mathbf{22}_G$ are carried out.

In the refresh operation, the signal line 31 having high load capacitance is neither charged nor discharged. In other words, due to the operation of the inverter circuit 23 and the first to fourth switching transistors 24 to 27, the refresh operation for the held potential $PIX_G$ of the holding capacitance $\mathbf{22}_G$ can be carried out without charge and discharge of the signal line 31 having high load capacitance.

The above-described polarity inversion operation and refresh operation for the held potential $PIX_G$ of the holding capacitance $\mathbf{22}_G$ are repeatedly carried out with the three-frame cycle in the period of the memory display mode. Although the above description is made by taking as an example the case of the sub-pixel $\mathbf{20}_G$, the above-described operation is carried out in turn about the sub-pixel $\mathbf{20}_R$ corresponding to red displaying, the sub-pixel $\mathbf{20}_G$ corresponding to green displaying, and the sub-pixel $\mathbf{20}_B$ corresponding to blue displaying on each frame basis. The order of the sub-pixel may be arbitrary order.

As described above, in the driving method according to operation example 1, the following operation and effect can be achieved by giving the middle potential $V_{mid}$ to the input terminal of the inverter circuit 23 before the start of the period of reading of the held potential $PIX_G$ from the holding capacitance $\mathbf{22}_G$. Specifically, the potential difference between the held potential $PIX_G$ applied to the input terminal of the inverter circuit 23 and the input potential $INV_{in}$ before the application (i.e. middle potential $V_{mid}$) becomes smaller than that when the middle potential $V_{mid}$ is not given.

Due to this feature, the amount $\Delta V_2$ of lowering of the input potential $INV_{in}$ of the inverter circuit 23 attributed to capacitance distribution can be made smaller than that when the middle potential $V_{mid}$ is not given, in application of the held potential $PIX_G$ of the holding capacitance $\mathbf{22}_G$ to the input terminal of the inverter circuit 23. Therefore, the operating margin of the inverter circuit 23 and hence the DRAM can be improved (enlarged) compared with the case in which the middle potential $V_{mid}$ is not given to the input terminal of the inverter circuit 23.

As is apparent from the above description of the operation, in operation example 1, the control line driver 50 shown in FIG. 1, which generates the control signal $GATE_1$ and the control signal $SR_1$ to drive the first and third switching transistors 24 and 26, serves as the driver that performs driving to give the middle potential $V_{mid}$ to the input terminal of the inverter circuit 23.

By the way, after the polarity inversion operation of the inverter circuit 23, the third switching transistor 26 is in the non-conductive state and therefore the input terminal of the inverter circuit 23 is in the floating state. In this floating state, the input potential $INV_{in}$ of the inverter circuit 23, which has been lowered to the potential of $V_{DD1}$ $(=V_{DD})-\Delta V$ due to capacitance coupling, is in an unsettled state and possibly lowered due to e.g. leakage current.

If the input potential $INV_{in}$ surpasses the threshold voltage $V_{thp}$ of the PchMOS transistor 231 included in the inverter circuit 23, i.e. becomes lower than $V_{DD1}$ $(=V_{DD})-V_{thp}$, the PchMOS transistor 231 becomes the conductive state. At this time, the NchMOS transistor 232 is in the conductive state and therefore the through current flows through the inverter circuit 23 via the MOS transistors 231 and 232. The flow of the through current through the inverter circuit 23 causes increase in the power consumption of the individual pixels 20 and hence the power consumption of the whole liquid crystal display device 10.

So, in the pixel 20 according to operation example 1, the input potential $INV_{in}$ of the inverter circuit 23 is settled to a supply potential for a certain period after writing of the inverted potential by the fourth switch element 27 in order to prevent the flow of the through current through the inverter circuit 23. Specifically, after the elapse of a certain period (in the present example, 1H) from the timing of the transition of the control signal $SR_2$ from the High-side potential $V_{DD2}$ to the Low-side potential $V_{SS2}$, the control signals $GATE_1$ and $SR_1$ are shifted from the Low-side potential $V_{SS2}$ to the High-side potential $V_{DD2}$ for only a certain period (in the present example, 1H).

At this time, instead of the signal potential reflecting the grayscale, a supply potential, e.g. the ground (GND) potential equivalent to the Low-side potential $V_{SS1}$, is output from the signal line driver 40 shown in FIG. 1 to the signal line 31. Due to the setting of the first and third switching transistors 24 and 26 to the conductive state in response to the control signals $GATE_1$ and $SR_1$, the ground (GND) potential is written from the signal line 31 to the input terminal of the inverter circuit 23 via these switching transistors 24 and 26.

This provides the state in which the input potential $INV_{in}$ of the inverter circuit 23 after the polarity inversion operation is settled to the supply potential, specifically the ground (GND) potential. In the state in which input potential $INV_{in}$ is settled to the ground potential, the NchMOS transistor 232 is surely set to the non-conductive state although the PchMOS transistor 231 is in the conductive state. Thus, the through current does not flow through the inverter circuit 23. This can suppress the power consumption of the individual pixels 20 and hence the power consumption of the whole liquid crystal display device 10.

In particular, specific operation and effect can be achieved by using the negative-side (Low-side) supply potential $V_{SS1}$, i.e. the ground (GND) potential in the present example, as the supply potential to settle the input potential $INV_{in}$ of the inverter circuit 23. Specifically, at the timing of the transition of the control signal $SR_1$ from the High-side potential $V_{DD2}$ to the Low-side potential $V_{SS2}$, the input potential $INV_{in}$ of the inverter circuit 23 is further dropped by a potential $\Delta V$ from the ground potential attributed to coupling due to parasitic capacitance existing between the gate and source of the third switching transistor 26.

Thus, the NchMOS transistor 232 can be set to the non-conductive state more surely and therefore the flow of the through current through the inverter circuit 23 can be avoided more surely. In particular, even if the input potential $INV_{in}$ rises due to the flow of some leakage current in the one-frame period until the settlement operation of the next frame, this potential rise is from (ground potential−ΔV) and therefore the non-conductive state of the NchMOS transistor 232 can be kept more surely compared with the case of potential rise from the ground potential.

Instead of the negative-side supply potential $V_{SS1}$, the positive-side supply potential $V_{DD1}$ may be written from the signal line 31 to the input terminal of the inverter circuit 23 as the supply potential to settle the input potential $INV_{in}$ of the inverter circuit 23. By settling the input potential $INV_{in}$ of the inverter circuit 23 to the positive-side supply potential $V_{DD1}$, the PchMOS transistor 231 can be surely set to the non-conductive state although the NchMOS transistor 232 is in the conductive state. Thus, the through current does not flow through the inverter circuit 23.

By the way, in the pixel 20 according to operation example 1, because of employment of the configuration in which the holding capacitance 22 is used as a DRAM, the writing path from the signal line 31 to the holding capacitance 22 is based on a double-transistor structure composed of the first and second switching transistors 24 and 25. According to this double-transistor structure, even when leakage current beyond the specified value flows through one switching transistor 24/25, the flow of this leakage current beyond the specified value can be prevented by the other switching transistor 25/24. Therefore, the liquid crystal display panel $\mathbf{10}_A$ in which the leakage current is made smaller than the specified value can be obtained.

To settle the input potential $INV_{in}$ of the inverter circuit 23 to a supply potential, generally a technique of always setting the first switching transistor 24 to the conductive state to give the supply potential from the signal line 31 to the input terminal of the inverter circuit 23 will be considered. However, in the case of employing the double-transistor structure in the pixel 20 utilizing the holding capacitance 22 as a DRAM, always setting the first switching transistor 24 to the conductive state is not preferable in view of the above-described leakage current. Therefore, in the pixel 20 according to operation example 1 employing the double-transistor structure, it is effective to use a technique of setting the first switching transistor 24 to the conductive state for only a certain period in the one-frame period to give the supply potential from the signal line 31 to the input terminal of the inverter circuit 23 as described above.

2-4. Operation Example 2

FIGS. 12A to 12H are timing waveform diagrams for explaining the operation of a driving method according to operation example 2 for giving the middle potential to the input terminal of the inverter circuit 23, specifically for explaining the operation in the memory display mode regarding a certain scan line.

The following description will also be made by taking, as an example, the case of the sub-pixel $\mathbf{20}_G$ corresponding to green in the pixel circuit of the above-described pixel configuration example 2. However, operation similar to that for the sub-pixel $\mathbf{20}_G$ is carried out also for the sub-pixels $\mathbf{20}_R$ and $\mathbf{20}_B$ of the other colors and the pixel circuit of pixel configuration example 1.

Figures 12A, 12B, 12C, 12D, 12E, 12F, 12G, 12H:
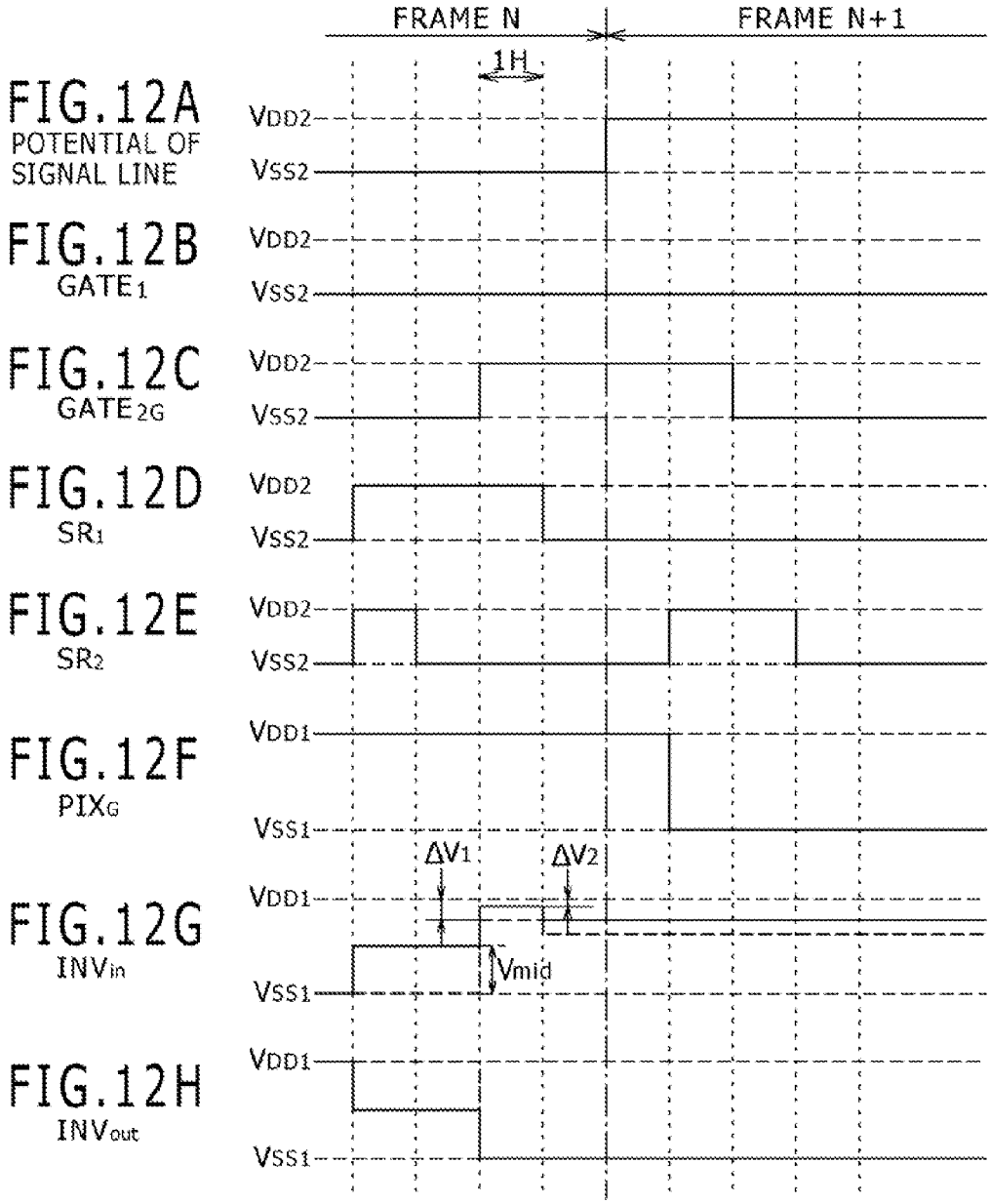
FIGS. 12A to 12H are timing waveform diagrams for explaining the operation of a driving method according to operation example 2 for giving the middle potential to the input terminal of the inverter circuit.

In FIGS. 12A to 12E, the waveforms of FIG. 12A the potential of the signal line 31, FIG. 12B the control signal $GATE_1$, FIG. 12C the control signal $GATE_{2G}$ corresponding to G, FIG. 12D the control signal $SR_1$, and FIG. 12E the control signal $SR_2$ around the boundary part of the frame in FIGS. 10A to 10H are shown in an enlarged manner. Furthermore, in FIGS. 12F to 12H, the waveforms of the potential $PIX_G$ held in the holding capacitance $\mathbf{22}_G$ (held potential), the input potential $INV_{in}$ of the inverter circuit 23, and the output potential $INV_{out}$ thereof are also shown in an enlarged manner.

In FIGS. 12A to 12H, the present frame is represented as frame N and the next frame is represented as frame N+1. In the present example, e.g. 1H is used as the unit of the pulse width of the control signals $GATE_1$, $GATE_{2G}$, $SR_1$, and $SR_2$.

Similarly to operation example 1, due to setting of the control signal $GATE_{2G}$ to the High-side potential $V_{DD2}$ and setting of the second switching transistor $\mathbf{25}_G$ to the conductive state, the second operating mode starts. The operation that will be described below and is carried out before the start of this second operating mode is one of characteristic points of operation example 2. Specifically, before (in the present example, 2H before) the start of the reading period of the second operating mode, both the control signals $SR_1$ and $SR_2$ are set to the High-side potential $V_{DD2}$.

In the present example, the control signal $SR_1$ is set to the High-side potential $V_{DD2}$ over a 3H period. In the third-H period of this 3H period, the period of the High-side potential $V_{DD2}$ overlaps with that of the control signal $GATE_{2G}$. The control signal $SR_2$ is set to the High-side potential $V_{DD2}$ for only a 1H period.

The following operation is also possible. Specifically, the control signal $SR_1$ is also set to the High-side potential $V_{DD2}$ for only a 1H period. Thereafter, similarly to operation example 1, the control signal $SR_1$ is set to the High-side potential $V_{DD2}$ again when the control signal $GATE_{2G}$ is set to the High-side potential $V_{DD2}$. However, setting the control signal $SR_1$ to the High-side potential $V_{DD2}$ over a 3H period continuously is preferable in view of suppression of the power consumption because the number of times of switching operation of the third switching transistor 26 is smaller.

Before the start of the reading period of the second operating mode, both the control signals $SR_1$ and $SR_2$ are set to the High-side potential $V_{DD2}$ and thereby both the third and fourth switching transistors 26 and 27 become the conductive state. Thus, the input and output terminals of the inverter circuit 23 are electrically connected (short-circuited) via the third and fourth switching transistors 26 and 27.

Because of the characteristic of the inverter circuit 23, the input potential $INV_{in}$ of the inverter circuit 23 becomes the middle potential $V_{mid}$ in the operating supply voltage range thereof due to the short-circuiting between the input and output terminals. After the input potential $INV_{in}$ of the inverter circuit 23 is set to the middle potential $V_{mid}$ in this manner, the control signal $GATE_{2G}$ is set to the High-side potential $V_{DD2}$ and the second switching transistor $\mathbf{25}_G$ becomes the conductive state, so that the second operating mode starts.

Around the frame boundary part, where the control signal $GATE_{2G}$ is set to the High-side potential $V_{DD2}$ and the second switching transistor $\mathbf{25}_G$ becomes the conductive state, the control signal $SR_1$ is continuously set to the High-side potential $V_{DD2}$ and thereby the third switching transistor 26 is in the conductive state. Thus, the held potential $PIX_G$ of the holding capacitance $\mathbf{22}_G$ is read out via the second and third switching transistors $\mathbf{25}_G$ and 26 and given to the input terminal of the inverter circuit 23.

The input potential $INV_{in}$ of the inverter circuit 23 is set to the middle potential $V_{mid}$ before the start of the period of reading of the held potential $PIX_G$ from the holding capacitance $\mathbf{22}_G$. Due to this feature, the potential difference between the held potential $PIX_G$ applied to the input terminal of the inverter circuit 23 and the input potential $INV_{in}$ before the application (i.e. middle potential $V_{mid}$) becomes smaller than that when the input potential $INV_{in}$ is not set to the middle potential $V_{mid}$.

Therefore, in application of the held potential $PIX_G$ of the holding capacitance $\mathbf{22}_G$ to the input terminal of the inverter circuit 23, the amount $\Delta V_2$ of lowering of the input potential $INV_{in}$ of the inverter circuit 23 due to capacitance distribution can be made smaller than the amount $\Delta V_1$ of lowering when the input potential $INV_{in}$ is not set to the middle potential $V_{mid}$. As a result, when the input potential $INV_{in}$ is set to the middle potential $V_{mid}$, the operating margin of the inverter circuit 23 and hence the DRAM can be improved (enlarged) compared with the case in which the input potential $INV_{in}$ of the inverter circuit 23 is not set to the middle potential $V_{mid}$.

After the start of the next frame N+1, the control signal $SR_2$ is set to the High-side potential $V_{DD2}$ and thereby the fourth switching transistor 27 becomes the conductive state. Due to this operation, the signal potential obtained by the polarity inversion (logic inversion) by the inverter circuit 23, i.e. the output potential $INV_{out}$ of the inverter circuit 23, is written to the holding capacitance $\mathbf{22}_G$ via the fourth and second switching transistors 27 and $\mathbf{25}_G$. As a result, the polarity of the held potential $PIX_G$ of the holding capacitance $\mathbf{22}_G$ is inverted. By this series of operation, the polarity inversion operation and the refresh operation for the held potential $PIX_G$ of the holding capacitance $\mathbf{22}_G$ are carried out.

In the refresh operation, the signal line 31 having high load capacitance is neither charged nor discharged. In other words, due to the operation of the inverter circuit 23 and the first to fourth switching transistors 24 to 27, the refresh operation for the held potential $PIX_G$ of the holding capacitance $\mathbf{22}_G$ can be carried out without charge and discharge of the signal line 31 having high load capacitance.

The above-described polarity inversion operation and refresh operation for the held potential $PIX_G$ of the holding capacitance $\mathbf{22}_G$ are repeatedly carried out with the three-frame cycle in the period of the memory display mode. Although the above description is made by taking as an example the case of the sub-pixel $\mathbf{20}_G$, the above-described operation is carried out in turn about the sub-pixel $\mathbf{20}_R$ corresponding to red displaying, the sub-pixel $\mathbf{20}_G$ corresponding to green displaying, and the sub-pixel $\mathbf{20}_B$ corresponding to blue displaying on each frame basis. The order of the sub-pixel may be arbitrary order.

As described above, in the driving method according to operation example 2, the same operation and effect as those of operation example 1 can be achieved by setting the input potential $INV_{in}$ of the inverter circuit 23 to the middle potential $V_{mid}$ before the start of the period of reading of the held potential $PIX_G$ from the holding capacitance $\mathbf{22}_G$. Specifically, by setting the input potential $INV_{in}$ of the inverter circuit 23 to the middle potential $V_{mid}$, the lowering of the input potential $INV_{in}$ due to capacitance distribution can be suppressed compared with the case in which the input potential $INV_{in}$ is not set to the middle potential $V_{mid}$. Thus, the operating margin of the DRAM can be improved.

As is apparent from the above description of the operation, in operation example 2, the control line driver 50 shown in FIG. 1, which generates the control signals $SR_1$ and $SR_2$ to drive the third and fourth switching transistors 26 and 27, serves as the driver that performs driving to give the middle potential $V_{mid}$ to the input terminal of the inverter circuit 23.

In addition to the above-described operation and effect, operation example 2 can achieve operation and effect that are not achieved in operation example 1 because of employment of the configuration in which the input potential $INV_{in}$ of the inverter circuit 23 is set to the middle potential $V_{mid}$ by short-circuiting between the input and output terminals of the inverter circuit 23. Specifically, inversion operation can be surely carried out without the influence of characteristic variation of the transistors configuring the inverter circuit 23. This point will be specifically described below.

Figure 13A:
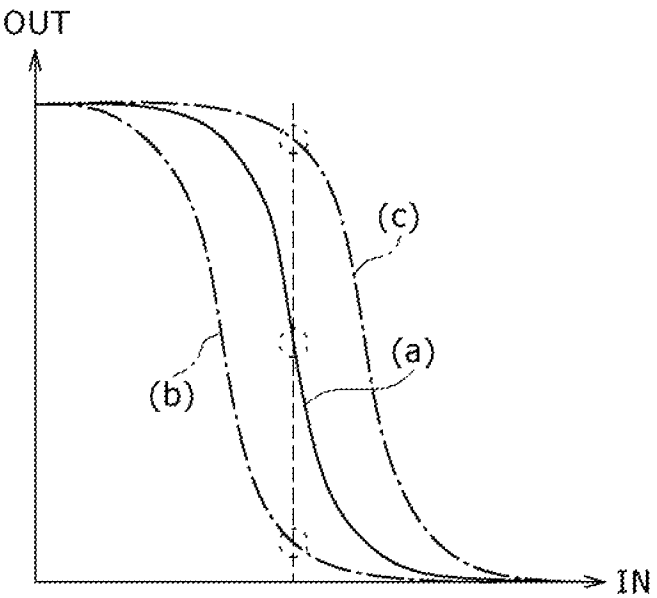
FIGS. 13A and 13B are explanatory diagrams about the inverter circuit in the case of operation example 1.

First, in operation example 1, in which a fixed potential, i.e. the middle potential $V_{mid}$, is input (given) to the input terminal of the inverter circuit 23, the input-output characteristic of the inverter circuit 23 is as shown in FIG. 13A. In FIG. 13A, solid line (a) shows a typical input-output characteristic and one-dot chain lines (b) and (c) show input-output characteristics when there is variation in the transistor characteristics of the inverter circuit 23. The points surrounded by the dotted-line circles indicate the operating point of the inverter circuit 23.

Figure 13B:
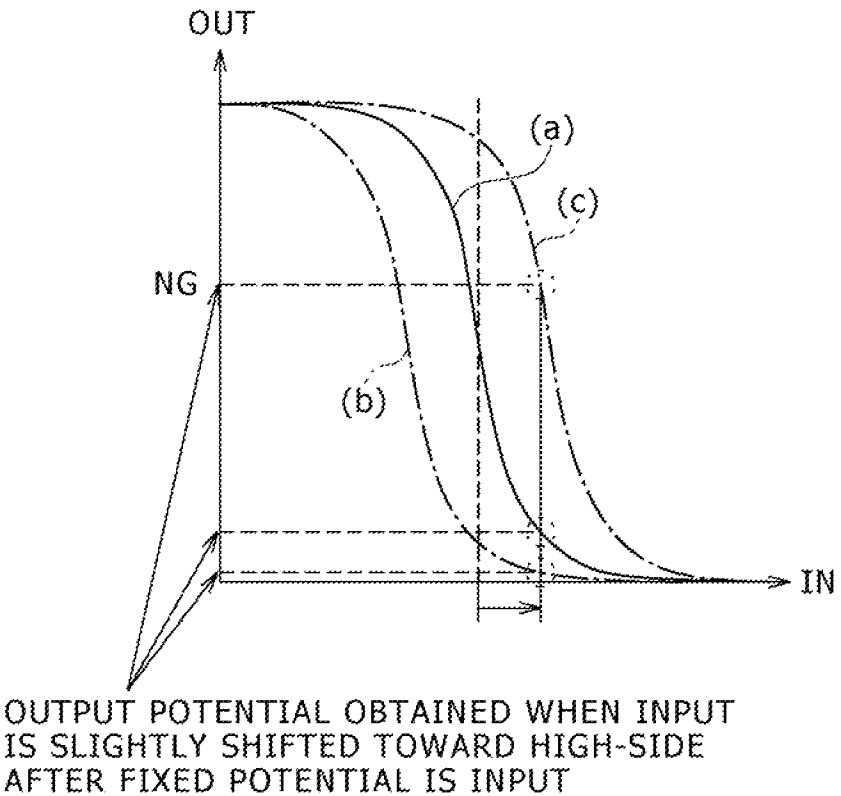

In operation example 1, in which a fixed potential is input to the input terminal of the inverter circuit 23, when the input potential $INV_{in}$ is slightly shifted toward the High-side after the fixed potential (middle potential $V_{mid}$) is input, the output potential $INV_{out}$ is not sufficiently turned to the Low-side potential due to the influence of the characteristic variation of the transistor in some cases. This is shown in FIG. 13B.

Figure 14A:
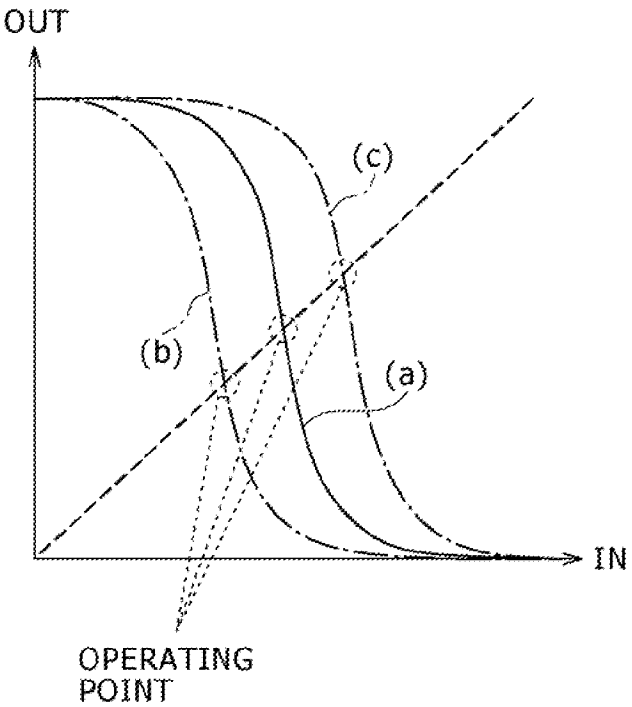
FIGS. 14A and 14B are explanatory diagrams about the inverter circuit in the case of operation example 2.

In operation example 2, in which the input and output terminals of the inverter circuit 23 are short-circuited, the input-output characteristic of the inverter circuit 23 is as shown in FIG. 14A. In FIG. 14A, solid line (a) shows a typical input-output characteristic and one-dot chain lines (b) and (c) show input-output characteristics when there is variation in the transistor characteristics of the inverter circuit 23. The points surrounded by the dotted-line circles indicate the operating point of the inverter circuit 23.

Figure 14B:
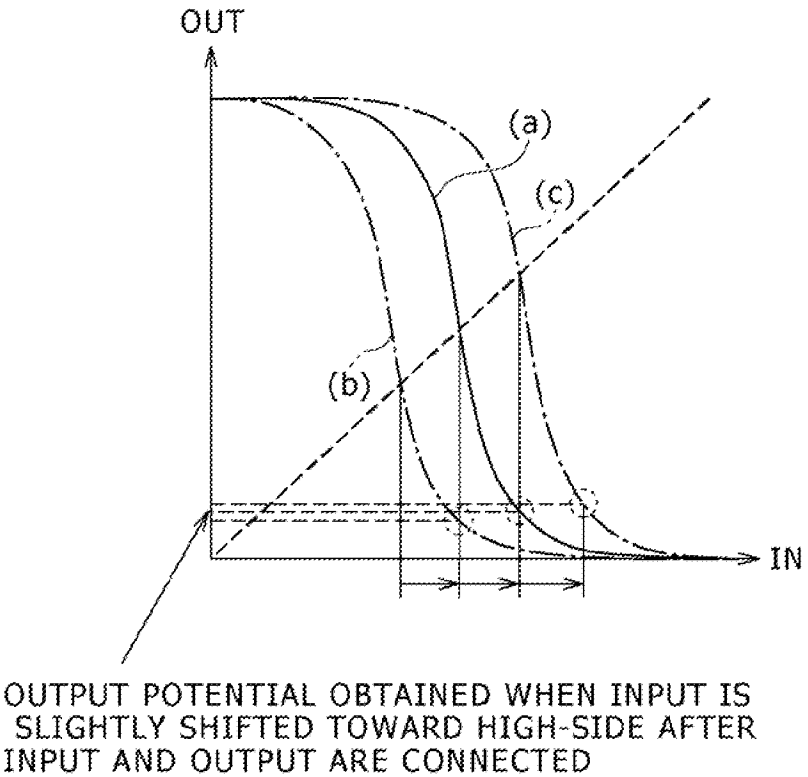

In operation example 2, in which the input and output terminals of the inverter circuit 23 are short-circuited, when the input potential $INV_{in}$ is slightly shifted toward the High-side after the input potential $INV_{in}$ is set to the middle potential $V_{mid}$, the output potential $INV_{out}$ is sufficiently turned to the Low-side potential even if characteristic variation of the transistors exists. This is shown in FIG. 14B.

As is apparent from the above description, in operation example 2, in which the input and output terminals of the inverter circuit 23 are short-circuited, inversion operation can be carried out more surely without the influence of characteristic variation of the transistors of the inverter circuit 23 compared with operation example 1, in which a fixed potential is input to the input terminal of the inverter circuit 23.

Furthermore, similarly to operation example 1, after the polarity inversion operation of the inverter circuit 23, the third switching transistor 26 is in the non-conductive state and the input terminal of the inverter circuit 23 is in the floating state. Therefore, the input potential $INV_{in}$ of the inverter circuit 23 is in an unsettled state. If the input potential $INV_{in}$ surpasses the threshold voltage $V_{thp}$ of the PchMOS transistor 231 included in the inverter circuit 23, i.e. becomes lower than $V_{DD1}$ $(=V_{DD})-V_{thp}$, the through current flows through the inverter circuit 23 and thus increase in the power consumption is caused.

So, also in the sub-pixels $\mathbf{20}_R$, $\mathbf{20}_G$, and $\mathbf{20}_B$ according to operation example 2, the input potential $INV_{in}$ of the inverter circuit 23 is settled to a supply potential for a certain period after writing of the inverted potential by the fourth switch element 27 in order to prevent the flow of the through current through the inverter circuit 23, similarly to operation example 1. Specifically, for example after the elapse of a certain period (in the present example, 1H) from the timing of the transition of the control signal $SR_2$ from the High-side potential $V_{DD2}$ to the Low-side potential $V_{SS2}$, the control signals $GATE_1$ and $SR_1$ are shifted from the Low-side potential $V_{SS2}$ to the High-side potential $V_{DD2}$ for only a certain period (in the present example, 1H).

At this time, instead of the signal potential reflecting the grayscale, a supply potential, e.g. the ground (GND) potential equivalent to the Low-side potential $V_{SS1}$, is output from the signal line driver 40 shown in FIG. 1 to the signal line 31. Due to the setting of the first and third switching transistors 24 and 26 to the conductive state in response to the control signals $GATE_1$ and $SR_1$, the ground (GND) potential is written from the signal line 31 to the input terminal of the inverter circuit 23 via these switching transistors 24 and 26.

This provides the state in which the input potential $INV_{in}$ of the inverter circuit 23 after the polarity inversion operation is settled to the supply potential, specifically the ground (GND) potential. In the state in which input potential $INV_{in}$ is settled to the ground potential, the NchMOS transistor 232 is surely set to the non-conductive state although the PchMOS transistor 231 is in the conductive state. Thus, the through current does not flow through the inverter circuit 23. This can suppress the power consumption of the individual pixels 20 and hence the power consumption of the whole liquid crystal display device 10.

In particular, specific operation and effect can be achieved by using the negative-side (Low-side) supply potential $V_{SS1}$, i.e. the ground (GND) potential in the present example, as the supply potential to settle the input potential $INV_{in}$ of the inverter circuit 23. Specifically, at the timing of the transition of the control signal $SR_1$ from the High-side potential $V_{DD2}$ to the Low-side potential $V_{SS2}$, the input potential $INV_{in}$ of the inverter circuit 23 is further dropped by a potential $\Delta V$ from the ground potential attributed to coupling due to parasitic capacitance existing between the gate and source of the third switching transistor 26.

Thus, the NchMOS transistor 232 can be set to the non-conductive state more surely and therefore the flow of the through current through the inverter circuit 23 can be avoided more surely. In particular, even if the input potential $INV_{in}$ rises due to the flow of some leakage current in the one-frame period until the settlement operation of the next frame, this potential rise is from (ground potential−$\Delta V$) and therefore the non-conductive state of the NchMOS transistor 232 can be kept more surely compared with the case of potential rise from the ground potential.

Instead of the negative-side supply potential $V_{SS1}$, the positive-side supply potential $V_{DD1}$ may be written from the signal line 31 to the input terminal of the inverter circuit 23 as the supply potential to settle the input potential $INV_{in}$ of the inverter circuit 23. By settling the input potential $INV_{in}$ of the inverter circuit 23 to the positive-side supply potential $V_{DD1}$, the PchMOS transistor 231 can be surely set to the non-conductive state although the NchMOS transistor 232 is in the conductive state. Thus, the through current does not flow through the inverter circuit 23.

3. Modification Example

Regarding the above-described embodiment, the example in which the inverter circuit 23 is provided for each pixel 20 based on a one-to-one correspondence relationship (pixel configuration example 1) and the example in which one inverter circuit 23 is provided in common to three sub-pixels $\mathbf{20}_R$, $\mathbf{20}_G$, and $\mathbf{20}_B$ (pixel configuration example 2) have been described. However, they are merely one example. For example, it is also possible to employ a configuration in which one inverter circuit 23 is shared by four or more pixels (sub-pixels).

Specifically, it is also possible to employ e.g. a configuration in which one inverter circuit 23 is shared by two unit pixels each composed of sub-pixels of R, G, and B, i.e. shared by six sub-pixels, in a liquid crystal display device for color displaying. As the number of pixels (sub-pixels) that share one inverter circuit 23 increases, the number of circuit elements configuring the liquid crystal display panel 10A can be reduced and correspondingly the yield of the liquid crystal display panel 10A can be enhanced.

Figure 15:
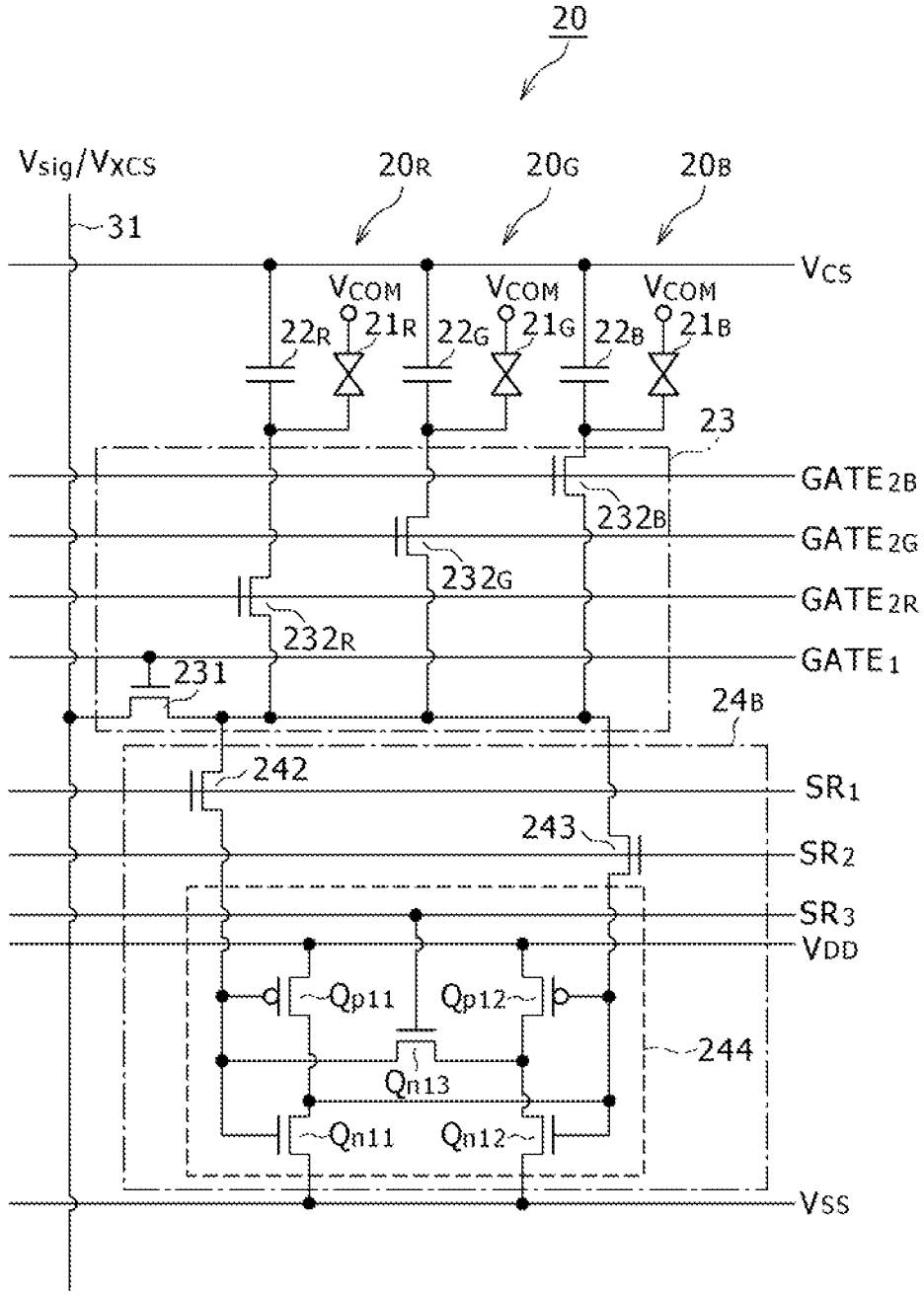
FIG. 15 is a circuit diagram of a pixel circuit in which a latch circuit is used as the inverter circuit in pixel configuration example 2 as an example.

As the "inverter circuit," a latch circuit like that shown in FIG. 15 may be used. FIG. 15 is a circuit diagram of a pixel circuit in which a latch circuit is used as the inverter circuit in pixel configuration example 2 as a modification example. In FIG. 15, the part equivalent to that in FIG. 8 is given the same symbol.

In the pixel circuit according to the present modification example, a polarity inverting unit $\mathbf{24}_B$ has a latch circuit 244, a third switch element 242, and a fourth switch element 243. Also in the present modification example, e.g. thin film transistors are used as switching transistors 231, $\mathbf{232}_R$, $\mathbf{232}_G$, $\mathbf{232}_B$, 242, and 243 serving as the switch elements. Although NchMOS transistors are used as the switching transistors 231, $\mathbf{232}_R$, $\mathbf{232}_G$, $\mathbf{232}_B$, 242, and 243, it is also possible to use PchMOS transistors.

(Circuit Configuration)

In FIG. 15, the circuit configuration of a selector part 23 is the same as that in pixel configuration example 2. Specifically, one main electrode (drain electrode/source electrode) of the first switching transistor 231 is connected to the signal line 31. The first switching transistor 231 is set to the conductive state when the signal potential ($V_{sig}/V_{XCS}$) reflecting the grayscale is written (captured) in the pixel 20 from the signal line 31 under control by the control signal $GATE_1$.

One main electrode of the second switching transistor $\mathbf{232}_R$ is connected to the pixel electrode of the liquid crystal capacitance $\mathbf{21}_R$ and one electrode of the holding capacitance $\mathbf{22}_R$ in common, and the other main electrode of the second switching transistor $\mathbf{232}_R$ is connected to the other main electrode of the first switching transistor 231. The second switching transistor $\mathbf{232}_R$ is set to the conductive state when the signal potential ($V_{sig}/V_{XCS}$) reflecting the grayscale is written to the holding capacitance $\mathbf{22}_R$ under control by the control signal $GATE_{2R}$ corresponding to red.

One main electrode of the second switching transistor $\mathbf{232}_G$ is connected to the pixel electrode of the liquid crystal capacitance $\mathbf{21}_G$ and one electrode of the holding capacitance $\mathbf{22}_G$ in common, and the other main electrode of the second switching transistor $\mathbf{232}_G$ is connected to the other main electrode of the first switching transistor 231. The second switching transistor $\mathbf{232}_G$ is set to the conductive state when the signal potential ($V_{sig}/V_{XCS}$) reflecting the grayscale is written to the holding capacitance $\mathbf{22}_G$ under control by the control signal $GATE_{2G}$ corresponding to green.

One main electrode of the second switching transistor $\mathbf{232}_B$ is connected to the pixel electrode of the liquid crystal capacitance $\mathbf{21}_B$ and one electrode of the holding capacitance $\mathbf{22}_B$ in common, and the other main electrode of the second switching transistor $\mathbf{232}_B$ is connected to the other main electrode of the first switching transistor 231. The second switching transistor $\mathbf{232}_B$ is set to the conductive state when the signal potential ($V_{sig}/V_{XCS}$) reflecting the grayscale is written to the holding capacitance $\mathbf{22}_B$ under control by the control signal $GATE_{2B}$ corresponding to blue.

In the polarity inverting unit $\mathbf{24}_B$, the latch circuit 244 is composed of two CMOS inverters. Specifically, one CMOS inverter is composed of a PchMOS transistor $Q_{p11}$ and an NchMOS transistor $Q_{n11}$ connected in series between the power supply line of the supply potential $V_{DD}$ and the power supply line of the supply potential $V_{SS}$. Similarly, the other CMOS inverter is composed of a PchMOS transistor $Q_{p12}$ and an NchMOS transistor $Q_{n12}$ connected in series between the power supply line of the supply potential $V_{DD}$ and the power supply line of the supply potential $V_{SS}$.

The gate electrodes of the PchMOS transistor $Q_{p11}$ and the NchMOS transistor $Q_{n11}$ are connected in common and serve as the input terminal of the latch circuit 244. This input terminal is connected to the other main electrode of the third switching transistor 242. The gate electrodes of the PchMOS transistor $Q_{p12}$ and the NchMOS transistor $Q_{n12}$ are connected in common and serve as the output terminal of the latch circuit 244. This output terminal is connected to the other main electrode of the fourth switching transistor 243.

The gate electrodes of the PchMOS transistor $Q_{p11}$ and the NchMOS transistor $Q_{n11}$ are connected to the drain electrodes of the PchMOS transistor $Q_{p12}$ and the NchMOS transistor $Q_{n12}$ via a control transistor $Q_{n13}$. The gate electrodes of the PchMOS transistor $Q_{p12}$ and the NchMOS transistor $Q_{n12}$ are connected directly to the drain electrodes of the PchMOS transistor $Q_{p11}$ and the NchMOS transistor $Q_{n11}$.

Under control by a control signal $SR_3$, the control transistor $Q_{n13}$ selectively sets the latch circuit 244 to the activated state in execution of refresh operation in the memory display mode. Specifically, when the control transistor $Q_{n13}$ is in the conductive state, the latch circuit 244 composed of two CMOS inverters is set to the activated state. Due to the setting of the latch circuit 244 to the activated state, the polarity inversion operation and the refresh operation for the held potentials of the holding capacitances $\mathbf{22}_R$, $\mathbf{22}_G$, and $\mathbf{22}_B$ are carried out. When the control transistor $Q_{n13}$ is in the non-conductive state, two CMOS inverters each operate as an independent amplifier circuit.

One main electrode of the third switching transistor 242 is connected to the other main electrode of the first switching transistor 231, and the other main electrode of the third switching transistor 242 is connected to the input terminal of the latch circuit 244 (i.e. gate electrodes of the MOS transistors $Q_{p11}$ and $Q_{n11}$). The third switching transistor 242 is set to the non-conductive state when the signal potential ($V_{sig}$/$V_{XCS}$) is written in the pixel 20 from the signal line 31 under control by the control signal $SR_1$.

4. Application Examples

The above-described liquid crystal display device according to the embodiment can be applied to display devices that are included in pieces of electronic apparatus in all fields and display a video signal input to the electronic apparatus or a video signal generated in the electronic apparatus as image or video. As one example, the liquid crystal display device can be applied to display devices in e.g. various pieces of electronic apparatus shown in FIG. 16 to FIGS. 20A to 20G, specifically a television set, a digital camera, a notebook personal computer, a video camcorder, and a portable terminal device such as a cellular phone.

Using the liquid crystal display device according to the embodiment as display devices in pieces of electronic apparatus in all fields can contribute to increase in the definition of the display devices in various kinds of electronic apparatus and reduction in the power consumption of the electronic apparatus. Specifically, as is apparent from the above description of the embodiment, in the liquid crystal display device according to the embodiment, the holding capacitance in the pixel is utilized as a DRAM and thereby the pixel structure can be simplified compared with the case of using an SRAM. Thus, pixel microminiaturization can be achieved. In addition, the power consumption of the liquid crystal display device can be suppressed. For this reason, using the liquid crystal display device according to the embodiment can contribute to increase in the definition of the display devices in various kinds of electronic apparatus and reduction in the power consumption of the electronic apparatus.

The liquid crystal display device according to the embodiment encompasses also a device having a module shape based on a sealed configuration. Examples of such a device include a display module formed by providing a sealing part surrounding the pixel array unit and bonding an opposing unit formed of e.g. transparent glass by using this sealing part as an adhesive. In this transparent opposing part, e.g. a color filter, a protective film, and a light blocking film may be provided. In the display module, e.g. a circuit part to input and output a signal and so forth between the external and the pixel array unit and a flexible printed circuit (FPC) may be provided.

Specific examples of the electronic apparatus to which the embodiment is applied will be described below.

Figure 16:
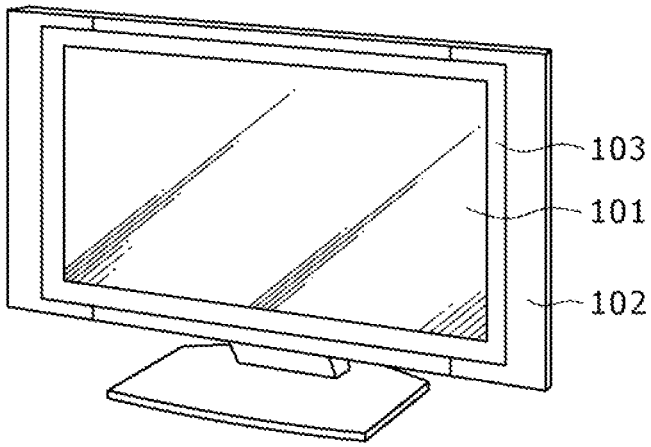
FIG. 16 is a perspective view showing the appearance of a television set to which the embodiment is applied.

FIG. 16 is a perspective view showing the appearance of a television set to which the embodiment is applied. The television set according to the present application example includes a video display screen unit 101 composed of a front panel 102, a filter glass 103, etc. and is fabricated by using the display device according to the embodiment as the video display screen unit 101.

Figure 17A:
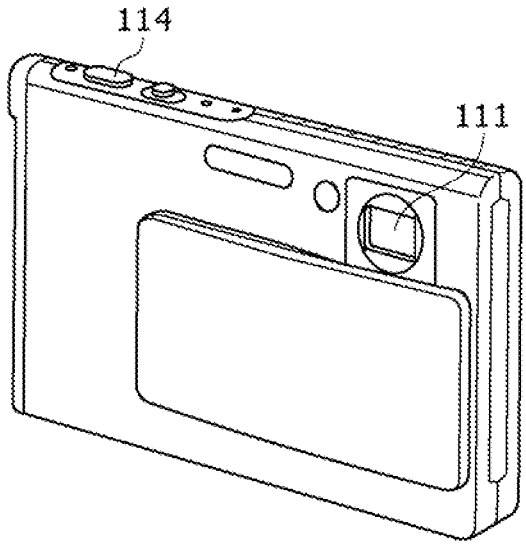
FIGS. 17A and 17B are perspective views showing the appearance of a digital camera to which the embodiment is applied.
Figure 17B:
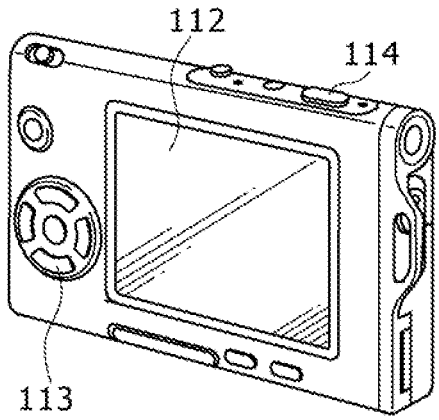

FIGS. 17A and 17B are perspective views showing the appearance of a digital camera to which the embodiment is applied: FIG. 17A is a perspective view of the front side and FIG. 17B is a perspective view of the back side. The digital camera according to the present application example includes a light emitter 111 for flash, a display unit 112, a menu switch 113, a shutter button 114, etc. and is fabricated by using the display device according to the embodiment as the display unit 112.

Figure 18:
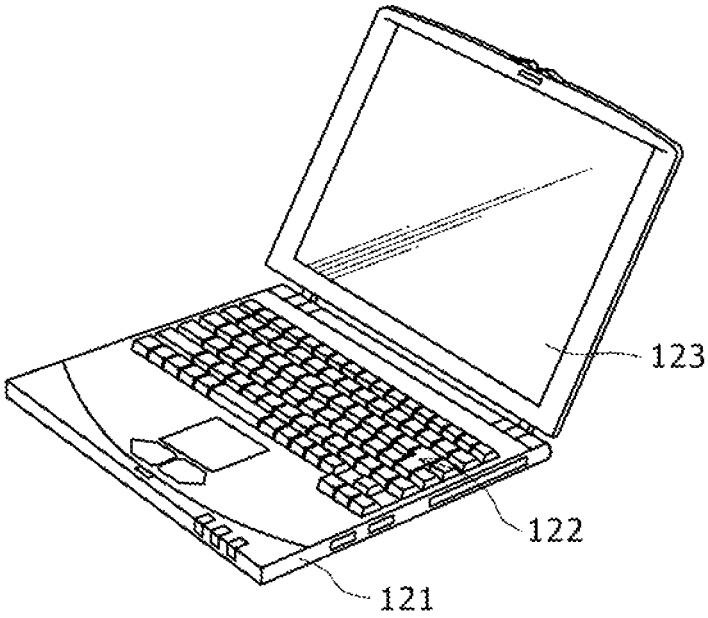
FIG. 18 is a perspective view showing the appearance of a notebook personal computer to which the embodiment is applied.

FIG. 18 is a perspective view showing the appearance of a notebook personal computer to which the embodiment is applied. The notebook personal computer according to the present application example includes a main body 121, a keyboard 122 operated in input of characters and so forth, a display unit 123 that displays images, etc. and is fabricated by using the display device according to the embodiment as the display unit 123.

Figure 19:
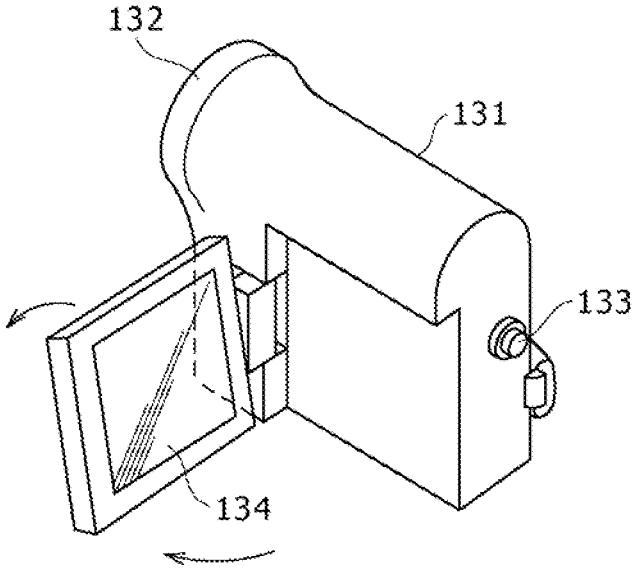
FIG. 19 is a perspective view showing the appearance of a video camcorder to which the embodiment is applied.

FIG. 19 is a perspective view showing the appearance of a video camcorder to which the embodiment is applied. The video camcorder according to the present application example includes a main body part 131, a lens 132 for subject photographing on the front side, a start/stop switch 133 for photographing, a display unit 134, etc. and is fabricated by using the display device according to the embodiment as the display unit 134.

Figure 20A:
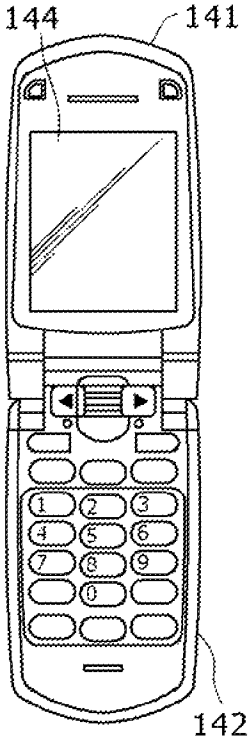
FIGS. 20A to 20G are appearance diagrams showing a cellular phone to which the embodiment is applied.
Figure 20B:
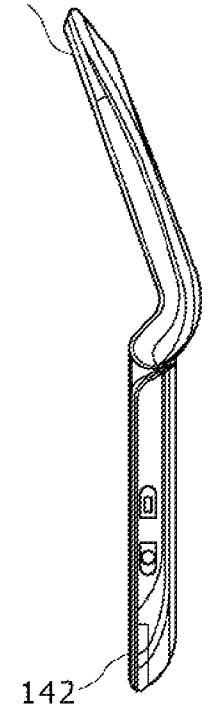
Figure 20D:
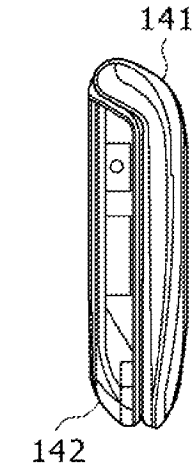
Figure 20C:
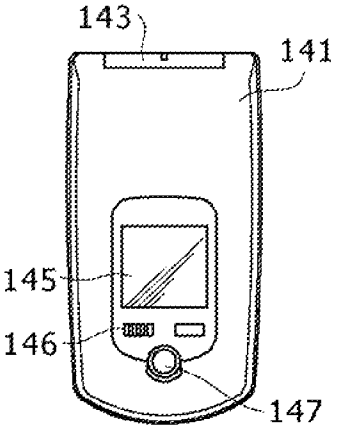
Figure 20E:
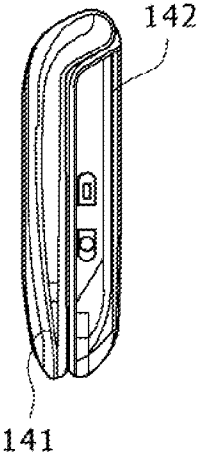
Figure 20F:
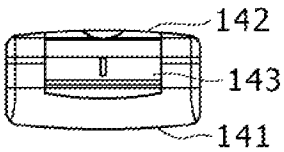
Figure 20G:
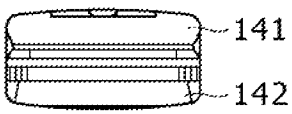
Figure 21:
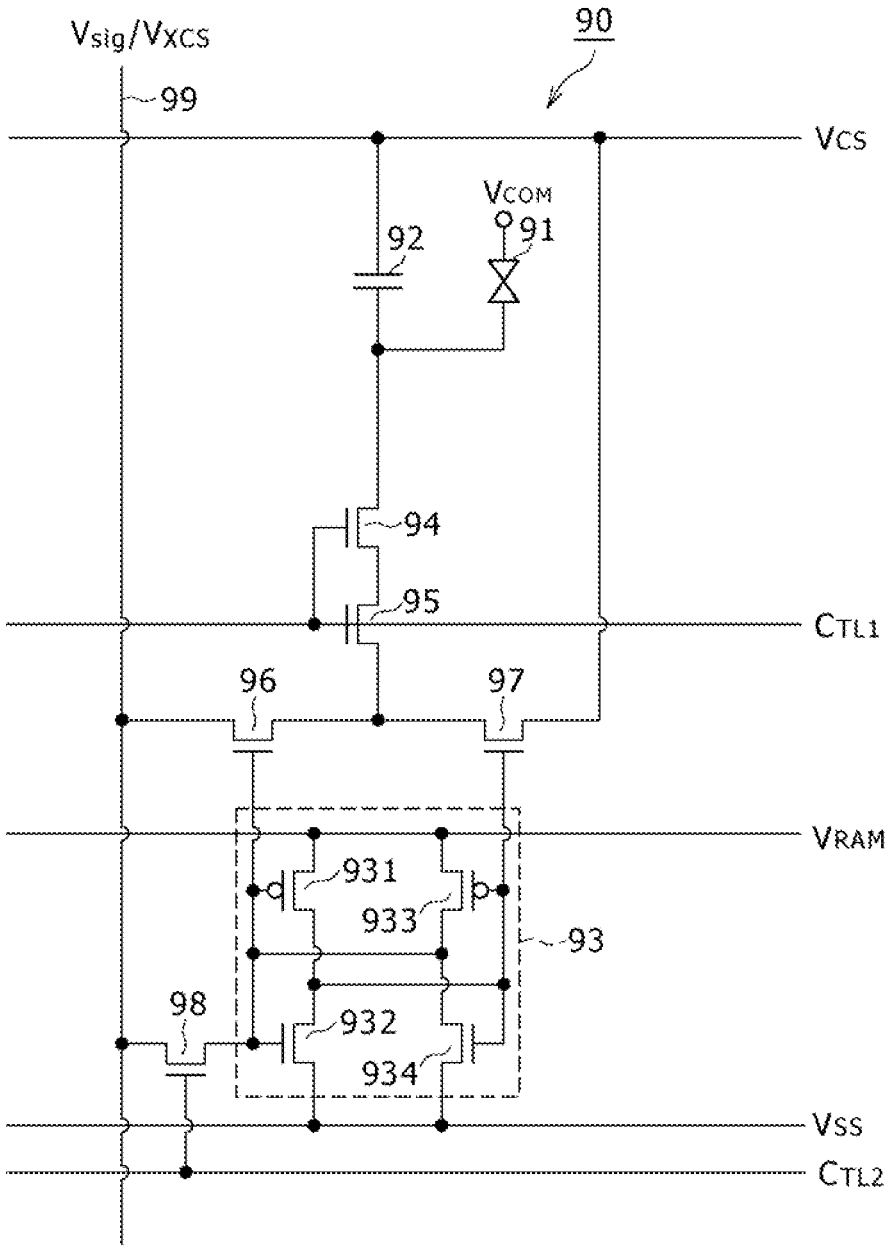
FIG. 21 is a circuit diagram showing one example of a pixel circuit of a liquid crystal display device according to a related-art example in which an SRAM is used as a memory in the pixel.
Figure 22:
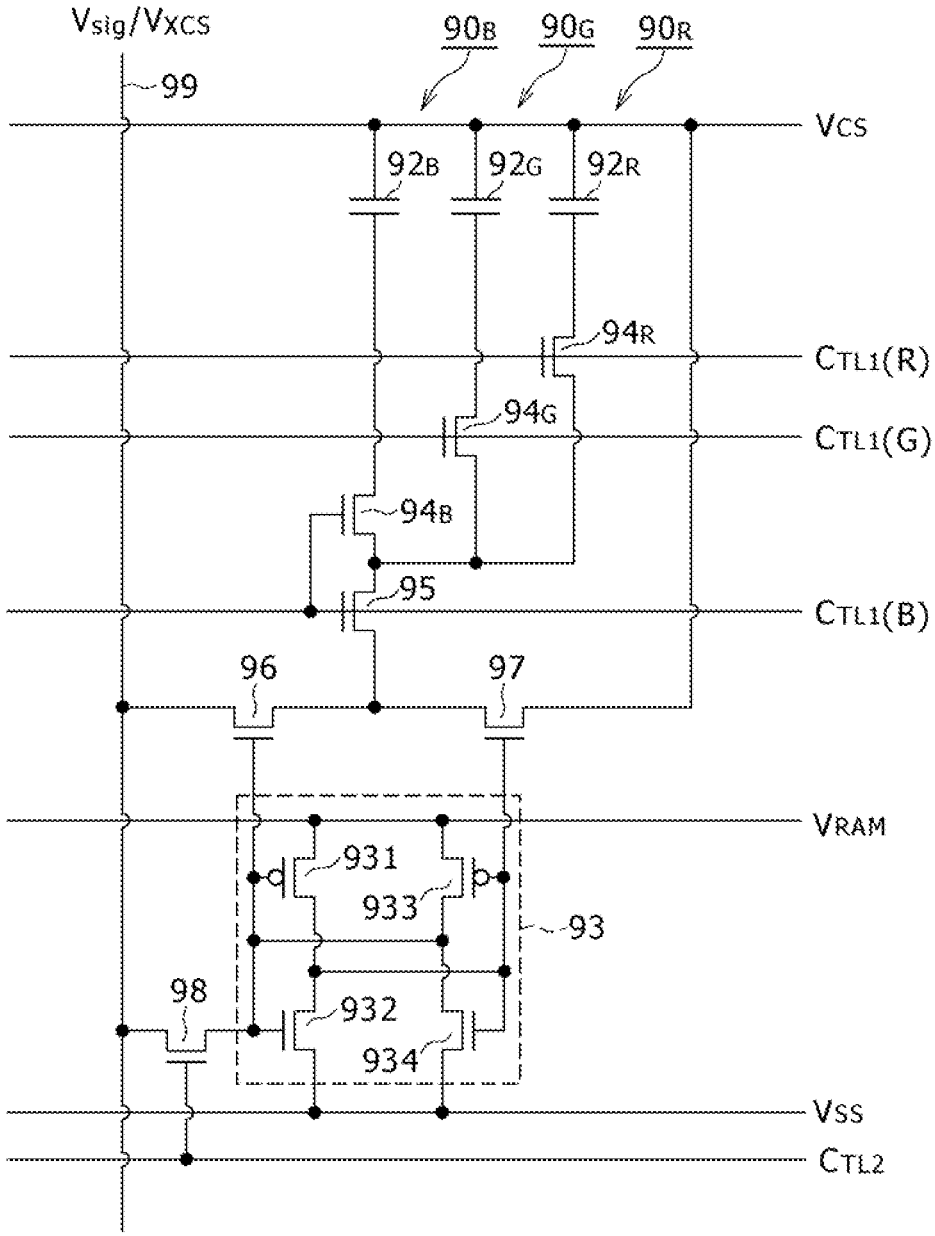
FIG. 22 is a circuit diagram showing one example of a pixel circuit of a liquid crystal display device according to a related-art example in which one SRAM is provided in common to sub-pixels of R, G, and B.

FIGS. 20A to 20G are appearance diagrams showing a cellular phone as one example of a portable terminal device to which the embodiment is applied: FIG. 20A is a front view of the opened state, FIG. 20B is a side view of the opened state, FIG. 20C is a front view of the closed state, FIG. 20D is a left side view, FIG. 20E is a right side view, FIG. 20F is a top view, and FIG. 20G is a bottom view. The cellular phone according to the present application example includes an upper housing 141, a lower housing 142, a connection part (hinge part, in this example) 143, a display 144, a sub-display 145, a picture light 146, a camera 147, etc. The cellular phone according to the present application example is fabricated by using the display device according to the embodiment as the display 144 and the sub-display 145.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The application is claimed as follows:

1. A display device having a pixel circuit comprising:

a pixel electrode;

a capacitive element configured to be connected to the pixel electrode of liquid crystal capacitance and hold a signal potential reflecting a grayscale; and an inverter circuit configured to invert a polarity of a held potential read out from the capacitive element, wherein an input potential of the inverter circuit is set to a middle potential in an operating supply voltage range of the inverter circuit in an operation of inverting the polarity of the held potential and writing an inverted potential to the capacitive element again after reading out the held potential from the capacitive element, wherein the display device further comprises:

a pixel array unit configured to be obtained by disposing pixels each including a first switch element that has one terminal connected to a signal line and is set to an on-state in a first operating mode of writing the signal potential that is given via the signal line and reflects the grayscale to the capacitive element, the first switch element being set to an off-state in a second operating mode of inverting the polarity of the held potential and writing the inverted potential to the capacitive element again after reading out the held potential from the capacitive element, a second switch element that has one terminal connected to the other terminal of the first switch element and has the other terminal connected to one electrode of the capacitive element and the pixel electrode, the second switch element being set to an on-state in the first operating mode and a reading period for reading out the held potential from the capacitive element and a rewriting period for writing the inverted potential to the capacitive element again in the second operating mode, a third switch element that has one terminal connected to the other terminal of the first switch element and is set to an off-state in the first operating mode, the third switch element being set to an on-state in the reading period in the second operating mode and reading out the held potential from the capacitive element via the second switch element, the inverter circuit that has an input terminal connected to the other terminal of the third switch element and inverts the polarity of the held potential read out from the capacitive element via the second switch element and the third switch element in the reading period in the second operating mode, and a fourth switch element that has one terminal connected to the other terminal of the first switch element and has the other terminal connected to an output terminal of the inverter circuit, the fourth switch element being set to an off-state in the first operating mode, the fourth switch element being set to an on-state in the rewriting period in the second operating mode and writing the inverted potential obtained by a polarity inversion by the inverter circuit to the capacitive element via the second switch element; and a driver configured to perform, for the pixel, driving to set the input potential of the inverter circuit to the middle potential in the operating supply voltage range of the inverter circuit before start of the reading period in the second operating mode, and wherein the driver sets the first switch element and the third switch element to an on-state before a start of the reading period in the second operating mode and gives the middle potential from the signal line to the input terminal of the inverter circuit via the first switch element and the third switch element.

2. The display device according to claim 1, wherein the driver sets the third switch element and the fourth switch element to an on-state before the start of the reading period in the second operating mode and electrically connects the input and output terminals of the inverter circuit via the third switch element and the fourth switch element.

3. The display device according to claim 1, wherein the inverter circuit is formed of a CMOS inverter, and input capacitance of the inverter circuit is set based on a channel length and a channel width of a PchMOS transistor and an NchMOS transistor of the CMOS inverter in such a manner that a capacitance ratio with respect to the capacitive element is about 1 to 10.

4. The display device according to claim 1, wherein the inverter circuit is provided one by one for each pixel.

5. An electronic apparatus including a display device having a pixel circuit comprising:

a pixel electrode;

a capacitive element configured to be connected to the pixel electrode and hold a signal potential reflecting a grayscale; and an inverter circuit configured to invert a polarity of a held potential read out from the capacitive element, wherein an input potential of the inverter circuit is set to a middle potential in an operating supply voltage range of the inverter circuit in an operation of inverting the polarity of the held potential and writing an inverted potential to the capacitive element again after reading out the held potential from the capacitive element, wherein the display device further comprises:

a pixel array unit configured to be obtained by disposing pixels each including a first switch element that has one terminal connected to a signal line and is set to an on-state in a first operating mode of writing the signal potential that is given via the signal line and reflects the grayscale to the capacitive element, the first switch element being set to an off-state in a second operating mode of inverting the polarity of the held potential and writing the inverted potential to the capacitive element again after reading out the held potential from the capacitive element, a second switch element that has one terminal connected to the other terminal of the first switch element and has the other terminal connected to one electrode of the capacitive element and the pixel electrode, the second switch element being set to an on-state in the first operating mode and a reading period for reading out the held potential from the capacitive element and a rewriting period for writing the inverted potential to the capacitive element again in the second operating mode, a third switch element that has one terminal connected to the other terminal of the first switch element and is set to an off-state in the first operating mode, the third switch element being set to an on-state in the reading period in the second operating mode and reading out the held potential from the capacitive element via the second switch element, the inverter circuit that has an input terminal connected to the other terminal of the third switch element and inverts the polarity of the held potential read out from the capacitive element via the second switch element and the third switch element in the reading period in the second operating mode, and a fourth switch element that has one terminal connected to the other terminal of the first switch element and has the other terminal connected to an output terminal of the inverter circuit, the fourth switch element being set to an off-state in the first operating mode, the fourth switch element being set to an on-state in the rewriting period in the second operating mode and writing the inverted potential obtained by a polarity inversion by the inverter circuit to the capacitive element via the second switch element; and a driver configured to perform, for the pixel, driving to set the input potential of the inverter circuit to the middle potential in the operating supply voltage range of the inverter circuit before start of the reading period in the second operating mode, and wherein the driver sets the first switch element and the third switch element to an on-state before a start of the reading period in the second operating mode and gives the middle potential from the signal line to the input terminal of the inverter circuit via the first switch element and the third switch element.

6. A display device having a pixel circuit comprising:

a pixel electrode;

a capacitive element configured to be connected to the pixel electrode and hold a signal potential reflecting a grayscale; and an inverter circuit configured to invert a polarity of a held potential read out from the capacitive element, wherein the pixel circuit carries out an operation of inverting the polarity of the held potential and writing an inverted potential to the capacitive element again after reading out the held potential from the capacitive element, and performs driving to give a supply potential from a signal line to an input terminal of the inverter circuit for a certain period after the operation, wherein the display device further comprises:

a pixel array unit configured to be obtained by disposing pixels each including a first switch element that has one terminal connected to the signal line and is set to an on-state in a first operating mode of writing the signal potential that is given via the signal line and reflects the grayscale to the capacitive element, the first switch element being set to an off-state in a second operating mode of inverting the polarity of the held potential and writing the inverted potential to the capacitive element again after reading out the held potential from the capacitive element, a second switch element that has one terminal connected to the other terminal of the first switch element and has the other terminal connected to one electrode of the capacitive element and the pixel electrode, the second switch element being set to an on-state in the first operating mode and a reading period for reading out the held potential from the capacitive element and a rewriting period for writing the inverted potential to the capacitive element again in the second operating mode, a third switch element that has one terminal connected to the other terminal of the first switch element and is set to an off-state in the first operating mode, the third switch element being set to an on-state in the reading period in the second operating mode and reading out the held potential from the capacitive element via the second switch element, the inverter circuit that has the input terminal connected to the other terminal of the third switch element and inverts the polarity of the held potential read out from the capacitive element via the second switch element and the third switch element in the reading period in the second operating mode, and a fourth switch element that has one terminal connected to the other terminal of the first switch element and has the other terminal connected to an output terminal of the inverter circuit, the fourth switch element being set to an off-state in the first operating mode, the fourth switch element being set to an on-state in the rewriting period in the second operating mode and writing the inverted potential obtained by a polarity inversion by the inverter circuit to the capacitive element via the second switch element; and a driver configured to perform, for the pixel, driving to give the supply potential from the signal line to the input terminal of the inverter circuit via the first switch element and the third switch element for a certain period after writing of the inverted potential by the fourth switch element.

7. The display device according to claim 6, wherein the inverter circuit is formed of a CMOS inverter.

8. The display device according to claim 6, wherein the third switch element is formed of a MOS transistor and lowers an input potential of the inverter circuit attributed to coupling due to parasitic capacitance existing between a gate and a source of the third switch element when being shifted from a conductive state to a non-conductive state.

9. The display device according to claim 6, wherein the inverter circuit is provided one by one for each pixel.

10. A display device comprising:

a pixel array unit configured to be obtained by disposing pixels each including a pixel electrode, a capacitive element having one electrode connected to the pixel electrode, a first switch element that has one terminal connected to a signal line and is set to an on-state in a first operating mode of writing a signal potential that is given via the signal line and reflects a grayscale to the capacitive element, the first switch element being set to an off-state in a second operating mode of inverting polarity of a held potential and writing an inverted potential to the capacitive element again after reading out the held potential from the capacitive element, a second switch element that has one terminal connected to the other terminal of the first switch element and has the other terminal connected to one electrode of the capacitive element and the pixel electrode, the second switch element being set to an on-state in the first operating mode and a reading period for reading out the held potential from the capacitive element and a rewriting period for writing the inverted potential to the capacitive element again in the second operating mode, a third switch element that has one terminal connected to the other terminal of the first switch element and is set to an off-state in the first operating mode, the third switch element being set to an on-state in the reading period in the second operating mode and reading out the held potential from the capacitive element via the second switch element, an inverter circuit that is formed of a CMOS inverter and has an input terminal connected to the other terminal of the third switch element, the inverter circuit inverting the polarity of the held potential read out from the capacitive element via the second switch element and the third switch element in the reading period in the second operating mode, and a fourth switch element that has one terminal connected to the other terminal of the first switch element and has the other terminal connected to an output terminal of the inverter circuit, the fourth switch element being set to an off-state in the first operating mode, the fourth switch element being set to an on-state in the rewriting period in the second operating mode and writing the inverted potential obtained by a polarity inversion by the inverter circuit to the capacitive element via the second switch element; and a driver configured to perform, for the pixel, driving to give a potential that sets one MOS transistor of the CMOS inverter to a non-conductive state from the signal line via the first switch element and the third switch element for a certain period after writing of the inverted potential by the fourth switch element.

11. The display device according to claim 10, wherein the potential that sets the one MOS transistor to a non-conductive state is equal to or higher than (VDD − Vthp) or is equal to or lower than (VSS + Vthn), if VDD is a positive-side supply potential of the inverter circuit, VSS is a negative-side supply potential of the inverter circuit, Vthp is a threshold voltage of a PchMOS transistor included in the CMOS inverter, and Vthn is a threshold voltage of an NchMOS transistor included in the CMOS inverter.

12. An electronic apparatus including a display device having a pixel circuit comprising:

a pixel electrode;

a capacitive element configured to be connected to the pixel electrode and hold a signal potential reflecting a grayscale; and an inverter circuit configured to invert a polarity of a held potential read out from the capacitive element, wherein the pixel circuit carries out an operation of inverting the polarity of the held potential and writing an inverted potential to the capacitive element again after reading out the held potential from the capacitive element, and performs driving to give a supply potential from the signal line to an input terminal of the inverter circuit for a certain period after the operation, wherein the display device further comprises:

a pixel array unit configured to be obtained by disposing pixels each including a first switch element that has one terminal connected to the signal line and is set to an on-state in a first operating mode of writing the signal potential that is given via the signal line and reflects the grayscale to the capacitive element, the first switch element being set to an off-state in a second operating mode of inverting the polarity of the held potential and writing the inverted potential to the capacitive element again after reading out the held potential from the capacitive element, a second switch element that has one terminal connected to the other terminal of the first switch element and has the other terminal connected to one electrode of the capacitive element and the pixel electrode, the second switch element being set to an on-state in the first operating mode and a reading period for reading out the held potential from the capacitive element and a rewriting period for writing the inverted potential to the capacitive element again in the second operating mode, a third switch element that has one terminal connected to the other terminal of the first switch element and is set to an off-state in the first operating mode, the third switch element being set to an on-state in the reading period in the second operating mode and reading out the held potential from the capacitive element via the second switch element, the inverter circuit that has the input terminal connected to the other terminal of the third switch element and inverts the polarity of the held potential read out from the capacitive element via the second switch element and the third switch element in the reading period in the second operating mode, and a fourth switch element that has one terminal connected to the other terminal of the first switch element and has the other terminal connected to an output terminal of the inverter circuit, the fourth switch element being set to an off-state in the first operating mode, the fourth switch element being set to an on-state in the rewriting period in the second operating mode and writing the inverted potential obtained by a polarity inversion by the inverter circuit to the capacitive element via the second switch element; and a driver configured to perform, for the pixel, driving to give the supply potential from the signal line to the input terminal of the inverter circuit via the first switch element and the third switch element for a certain period after writing of the inverted potential by the fourth switch element.

* * * * *